US011535807B2

(12) United States Patent
DeBlase

(10) Patent No.: US 11,535,807 B2
(45) Date of Patent: *Dec. 27, 2022

(54) REDUCED FRICTION LUBRICANTS COMPRISING MAGNESIUM DETERGENTS AND/OR OVERBASED MAGNESIUM DETERGENTS AND MOLYBDENUM BASED FRICTION MODIFIERS

(71) Applicant: LANXESS Corporation, Pittsburgh, PA (US)

(72) Inventor: Frank J. DeBlase, Hopewell Junction, NY (US)

(73) Assignee: LANXESS Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/764,475

(22) PCT Filed: Nov. 14, 2018

(86) PCT No.: PCT/US2018/060972

§ 371 (c)(1),
(2) Date: May 15, 2020

(87) PCT Pub. No.: WO2019/099471

PCT Pub. Date: May 23, 2019

(65) Prior Publication Data

US 2020/0354644 A1 Nov. 12, 2020

Related U.S. Application Data

(60) Provisional application No. 62/586,259, filed on Nov. 15, 2017, provisional application No. 62/727,849, filed on Sep. 6, 2018.

(51) Int. Cl.
*C10M 135/18* (2006.01)
*C10M 125/22* (2006.01)
(Continued)

(52) U.S. Cl.
CPC ..... *C10M 135/18* (2013.01); *C10M 125/22* (2013.01); *C10M 133/16* (2013.01);
(Continued)

(58) Field of Classification Search
CPC ..... C10M 133/16; C10M 163/00; C10M 135/18; C10M 169/04; C10M 125/22;
(Continued)

(56) References Cited

U.S. PATENT DOCUMENTS 4,129,589 A 12/1978 Eliades et al.
4,192,758 A 3/1980 Dickey et al.
(Continued)

FOREIGN PATENT DOCUMENTS

JP 07150170 H 6/1995
JP 07150173 A2 6/1995

OTHER PUBLICATIONS

European Search Report from corresponding European Application No. 20173809, dated Oct. 21, 2020, three pages.
(Continued)

*Primary Examiner* — Vishal V Vasisth
(74) *Attorney, Agent, or Firm* — Nicanor A. Kohncke; Christopher L. McDavid; Ewa M. Wozniak

(57) ABSTRACT

The addition of mixed thio acid amide molybdenum dithiocarbamates to lubricant compositions comprising magnesium detergents and/or overbased magnesium detergents, e.g., overbased magnesium sulfonate, provides lubricant compositions that suppress Low Speed Pre-Ignition and possess excellent low friction characteristics. Furthermore, the addition of molybdenum based friction reducing additives, e.g., mixed thio acid amide molybdenum dithiocarbamates, in combination with one or more fatty acid 2-hydroxyalkylamides, to lubricant compositions comprising magnesium detergents or overbased magnesium detergents
(Continued)

provides lubricant compositions that suppress Low Speed Pre-ignition and possess excellent low friction characteristics.

27 Claims, 11 Drawing Sheets

(51) Int. Cl.

| | |
|---|---|
| ***C10M 133/16*** | (2006.01) |
| ***C10M 169/04*** | (2006.01) |
| *C10N 30/00* | (2006.01) |
| *C10N 40/25* | (2006.01) |
| *C10N 10/04* | (2006.01) |
| *C10N 10/12* | (2006.01) |
| *C10N 30/04* | (2006.01) |

(52) U.S. Cl.
CPC .... *C10M 169/04* (2013.01); *C10M 2201/043* (2013.01); *C10M 2215/082* (2013.01); *C10M 2219/046* (2013.01); *C10M 2219/068* (2013.01); *C10N 2010/04* (2013.01); *C10N 2010/12* (2013.01); *C10N 2030/04* (2013.01); *C10N 2030/50* (2020.05); *C10N 2030/54* (2020.05); *C10N 2040/252* (2020.05); *C10N 2040/255* (2020.05)

(58) Field of Classification Search
CPC ..... C10M 2207/144; C10M 2207/028; C10M 2207/027; C10M 2219/046; C10M 2219/044; C10M 2219/068; C10M 2207/262; C10M 2201/043; C10M 2203/1025; C10M 2215/082; C10N 2030/52; C10N 2030/04; C10N 2040/255; C10N 2030/45; C10N 2010/04; C10N 2030/54; C10N 2010/12; C10N 2040/252; C10N 2030/06; C10N 2030/50; C10N 2060/14; C10N 2020/02
See application file for complete search history.

(56) References Cited

U.S. PATENT DOCUMENTS

| | | | | |
|---|---|---|---|---|
| 4,647,387 | A | 3/1987 | Muir | |
| 5,498,809 | A | 3/1996 | Emert et al. | |
| 5,534,168 | A | 7/1996 | Cleverley et al. | |
| 6,103,674 | A | 8/2000 | Nalesnik et al. | |
| 6,197,075 | B1 | 3/2001 | Muir et al. | |
| 6,723,685 | B2 | 4/2004 | Hartley et al. | |
| 7,696,136 | B2 | 4/2010 | Migdal et al. | |
| 9,562,207 | B2 | 2/2017 | DeBlase et al. | |
| 2008/0020955 | A1 | 1/2008 | Diggs et al. | |
| 2008/0119377 | A1* | 5/2008 | Devlin | C10M 141/10 508/371 |
| 2013/0203639 | A1 | 8/2013 | Roski et al. | |
| 2015/0133352 | A1* | 5/2015 | Esche | C10M 107/00 508/294 |
| 2015/0166922 | A1 | 6/2015 | DeBlase et al. | |
| 2015/0307802 | A1 | 10/2015 | Ritchie et al. | |
| 2015/0322367 | A1 | 11/2015 | Patel et al. | |
| 2015/0376537 | A1* | 12/2015 | DeBlase | C10M 133/16 508/555 |
| 2016/0251591 | A1 | 9/2016 | DeBlase et al. | |
| 2016/0326451 | A1* | 11/2016 | Esche | C10M 141/10 |
| 2017/0015927 | A1 | 1/2017 | Fletcher et al. | |
| 2017/0022441 | A1 | 1/2017 | Onodera | |
| 2018/0179243 | A1 | 6/2018 | Skinner et al. | |

OTHER PUBLICATIONS

International Search Report from International Application No. PCT/US18/60972, dated Apr. 17, 2019, four pages.

Written Opinion from International Application No. PCT/US18/60972, dated Apr. 17, 2019, eight pages.

Toyoharu Kaneko et al, "Friction Reduction Technology for Low Viscosity Engine Oil Compatible with LSPI Prevention Performance", SAE Technical Paper Series, vol. 1. Oct. 17, 2016 (Oct. 17, 2016), Abstract, available via the Internet on Apr. 29, 2020, at www.sae.org/publications/technical-papers/content/2016-01-2276/.

* cited by examiner

REDUCED FRICTION LUBRICANTS COMPRISING MAGNESIUM DETERGENTS AND/OR OVERBASED MAGNESIUM DETERGENTS AND MOLYBDENUM BASED FRICTION MODIFIERS

This application is a 371 of PCT/US18/60972, filed Nov. 14, 2018 which claims benefit of 62/586,259, filed Nov. 15, 2017 and claims benefit of 62/727,849, filed Sep. 6, 2018.

Efforts to improve fuel economy and reduce $CO_2$ emissions while maintaining overall performance continue. So far, manufacturers of automotive engines have developed smaller engines with higher power densities, increased boost pressure from turbochargers, and employed higher transmission gear ratios to attain higher torque at lower engine speeds, i.e., down-speeding. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure.

Low speed pre-ignition (LSPI) is a type of abnormal combustion that can affect engines using natural gas, gasoline, diesel, biofuels, and the like. Pre-ignition in an internal combustion engine is the ignition of the air/fuel mixture in a cylinder before the spark plug fires. The cause of pre-ignition is not fully understood, but may be attributed to multiple phenomena such as hot deposits within the combustion chamber, elevated levels of lubricant vapor entering from the PCV system, oil seepage past the turbocharger compressor seals or oil and/or fuel droplet auto-ignition during the compression stroke.

Downsized, downspeeded, turbocharged engines are most susceptible to LSPI. As the automobile industry continues to move towards further downsizing, downspeeding, etc, the concern over LSPI continues to grow.

Mechanical or engineering solutions to eliminate or limit pre-ignition continue to be developed, For example, improved spark plug selection, proper fuel/air mixture adjustment, periodic cleaning of the combustion chambers, cooled exhaust gas recirculation (EGR), new component technology, such as electronic controls, are known, but can be costly or inconvenient to implement.

Modifications to the lubricant formulation used in the engine, i.e., the motor oil, can greatly reduce or eliminate LSPI. For example, calcium detergents and overbased calcium detergents, comprising salts such as calcium sulfonates, calcium salicylates, calcium phenates, and related borated materials, are very common additives in lubricants used in automobile and truck engines. US 2015/0307802, 2015/0322367, and 20170015927 disclose that replacing some or all of the calcium detergent or overbased calcium detergent with similar or corresponding magnesium detergents or overbased magnesium detergents can greatly reduce LSPI.

The reasons for the improvements are not fully known. It appears that LSPI events may correlate with formation of deposits containing engine oil components at the interface of the engine piston ring and the piston ring groves. It has been suggested that such deposits may generate a residue which adsorbs unburned fuel or oil components, which outgas into the hot engine environment when start stop engines are in the stopped unfired mode, which once release, can produce low speed pre-ignition. Using magnesium detergents or overbased magnesium detergents, e.g., overbased magnesium sulfonate detergents, instead of calcium detergents, may reduce the formation and/or change the nature of the deposits at the engine piston ring and piston ring grove interface, leading to reduction of low speed pre-ignition events.

Using magnesium detergents, however, can have drawbacks. For example, based on the present Applicant's findings, the use of magnesium detergents results in an increased friction effect, although the exact mechanism of the effect (e.g., crystallinity, micellar system, etc.) is not fully understood. The increased friction would require the use of higher traditional friction modifier levels. Many of the most effective friction modifiers currently used in motor oils contain metals, e.g., molybdenum compounds, but an increase in metals or sulfur to compensate for the higher friction is undesirable as it will contribute to greater particulates and ash formation, negatively affecting emissions performance.

A variety of friction modifiers for lubricants are known, for example metal based friction modifiers, such as molybdenum friction modifiers, as well as non-metallic, fully organic compounds, such as fatty acid esters and amides, esters of hydroxyalkyl acids and the like.

Many molybdenum friction modifiers are available, including molybdenum dialkyldithiocarbamates, molybdenum dialkyl dithiophosphates, molybdenum disulfide, trimolybdenum cluster dialkyldithiocarbamates, non-sulfur molybdenum compounds and the like. Different molybdenum friction modifiers can contain different amounts of molybdenum, and most commercial molybdenum friction modifiers contain from about 6 to about 10% by weight, e.g., approximately 8 wt %.

U.S. Pat. No. 6,103,674 discloses a molybdenum based lubricating oil additive, i.e., a mixed thio acid amide molybdenum dithiocarbamate, that comprises the reaction product of: (a) an unsaturated or saturated ester or acid, (b) a diamine of the formula:

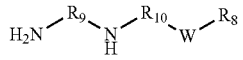

(c) carbon disulfide, and (d) a molybdenum compound, wherein $R_8$ is an alkyl group of 1 to 40 carbon atoms, $R_9$ and $R_{10}$ are independently selected aliphatic or aromatic moieties, and W is oxygen, sulfur, or —$CH_2$—. In addition to friction modification, the additive is said to impart beneficial antiwear, extreme pressure, and oxidation stability properties. These additives, being the reaction products of mono- or poly-functional organic acids or esters and an aliphatic diamine that are further reacted with carbon disulfide and then with molybdenum compounds, are complex mixtures.

U.S. Pat. No. 9,562,207 discloses a mixture of fatty acid amides, prepared by reacting a naturally occurring mixture of carboxylic acids or esters, e.g., acids or esters derived from beef tallow, with a secondary hydroxyalkyl amine, e.g., di-isopropanolamine, which fatty acid amides show improved friction reduction activity over similar compounds, e.g., amides formed from a primary hydroxyalkyl amine, such as di-ethanolamine.

The lubricant compositions of the present disclosure overcome the problems associated with high friction encountered when magnesium detergents replace calcium detergents in order to prevent/reduce LSPI, achieving excellent friction reduction even at very low levels of molybdenum.

Disclosed herein is a lubricant composition, e.g., an automobile or truck motor oil, comprising:

A) a lubricating oil, e.g., base oil, which typically comprises standard additives;

B) a magnesium detergent or overbased magnesium detergent; and

C) one or more molybdenum dithiocarbamates represented by the formula:

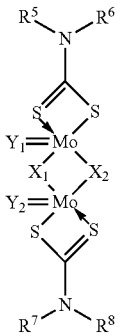

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group, and $X_1$, $X_2$, $Y_1$, and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group.

Also disclosed is a lubricant composition, e.g., an automobile or truck motor oil, comprising:

A) a lubricating oil, e.g., base oil, which typically comprises standard additives;

B) a magnesium detergent or overbased magnesium detergent; and

C) a mixed molybdenum thio acid amide dithiocarbamate comprising the reaction product of:

(a) an unsaturated or saturated ester or acid, (b) a diamine of the formula:

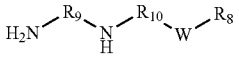

(c) carbon disulfide, and (d) a molybdenum compound, wherein $R_8$ is an akyl group of 1 to 40 carbon atoms, $R_9$ and $R_{10}$ are independently selected aliphatic or aromatic moieties, and W is oxygen, sulfur, or —$CH_2$—.

Also provided is a lubricant composition, e.g., an automobile or truck motor oil, comprising:

A) a lubricating oil, e.g., base oil, which typically comprises standard additives;

B) a magnesium detergent or overbased magnesium detergent;

C) a molybdenum based friction reducing additive; and

D) one or more fatty acid 2-hydroxyalkylamide, i.e., alkanolamide, compounds of formula I:

I

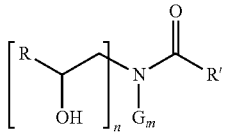

wherein n is 1 or 2; when n is 1, m is 1; when n is 2, m is 0,

R is H or $C_{12}$ alkyl,

G is H or $C_{1-6}$ alkyl, and

R' is selected from $C_{7-3}$ alkyl or alkenyl.

The molybdenum based friction reducing additive may be chosen from those known in the art. Suitable molybdenum based friction reducing additives include, but are not limited to, molybdenum dithiocarbamates (MoDTC) (e.g., monomolybdenum dithiocarbamates, di-molybdenum dithiocarbamates, tri-molybdenum cluster dithiocarbamates, etc.), molybdenum dithiophosphates, molybdenum dithiophosphinates, molybdenum xanthates, molybdenum thioxanthates, molybdenum alcoholates, molybdenum amines, molybdenum amides, molybdenum sulfides (e.g., molybdenum disulfide), non-sulfur molybdenum compounds, and mixtures thereof. The molybdenum compounds may be, e.g., mono-, di-, tri-, or tetra-nuclear. In some embodiments, the molybdenum based friction reducing additive includes one or more sulfur-containing molybdenum based compounds or complexes. In some embodiments, the molybdenum based friction reducing additive is chosen from molybdenum dithiocarbamates (MoDTC), molybdenum dithiophosphates, molybdenum dithiophosphinates, molybdenum xanthates, molybdenum thioxanthates, molybdenum sulfides, and mixtures thereof.

In some embodiments, the molybdenum based friction reducing additive comprises molybdenum dithiocarbamates as described for component C of the embodiments above.

The molybdenum based friction reducing additive may comprise a mixture of molybdenum based compounds. Other molybdenum based compounds in addition to those described above may be present.

In some embodiments, the one or more fatty acid alkanolamide compounds have a structure according to formula II:

II

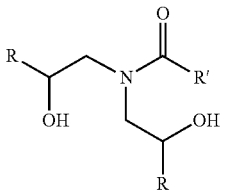

wherein R is H or $C_{1-12}$ alkyl (such as $C_{1-8}$ alkyl or $C_{1-4}$alkyl, e.g., methyl or ethyl); and R' is selected from $C_{7-23}$ alkyl or alkenyl (e.g., $C_{7-19}$ alkyl or alkenyl, or $C_{9-19}$ alkyl or alkenyl).

In some embodiments, the lubricant composition comprises a mixture of fatty acid alkanolamide compounds of formula I or II, i.e., two or more fatty acid alkanolamide compounds of formula I or II. In some embodiments, at least one fatty acid alkanolamide is a compound of formula I or II wherein R is selected from $C_{1-12}$ alkyl, such as $C_{1-8}$ alkyl or $C_{1-4}$ alkyl, e.g., methyl or ethyl.

In some embodiments, the one or more fatty acid alkanolamides are two or more compounds of formula I or II, wherein about 15 to about 45% by weight of the alkanolamides are compounds where R' is $C_{15}$ alkyl or alkenyl, about 40 to about 80% by weight of the alkanolamides are compounds where R' is $C_1$ alkyl or alkenyl, and 0 or 0.1 to about 15% by weight of the alkanolamides are compounds where R' is $C_{7-14}$, $C_{16}$ or $C_{18-19}$ alkyl or alkenyl.

More than one lubricant, i.e., lubricating oil or base oil, may be present in the lubricant composition.

Magnesium detergents and overbased magnesium detergents are well-known and one skilled in the art can make an appropriate selection. In many embodiments, the magnesium detergent or overbased magnesium detergent comprises salts selected from magnesium sulfonates, magnesium salicylates, magnesium phenates, and other related components (including borated detergents), and mixtures thereof. Often, overbased detergents are used. More than one magnesium detergent or overbased magnesium detergent may be present.

An overbased magnesium detergent may have a total base number (TBN) of greater than 120 mg KOH/gram, or as further examples, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater, as determined using the method of ASTM D-2896. In some embodiments, the overbased magnesium detergent, e.g., a magnesium sulfonate detergent, has a TBN ranging from about 120 to about 700 mg KOH/gram, or about 250 to about 600 mg KOH/gram, or about 300 to about 500 mg KOH/gram.

In many embodiments, the lubricating composition described herein comprises 1) the lubricating oil (component A in the embodiments above),
2) from about 0.2 to about 6.0 wt %, e.g., from about 0.3 to about 4 wt %, based on the total weight of the lubricant composition, of the magnesium detergent or overbased magnesium detergent (component B in the embodiments above), and
3) from 0.2 to 3 wt %, e.g., 0.2 to 1.5 wt %, based on the total weight of the lubricant composition, of the molybdenum friction modifier (component C in the embodiments above).

When present in the lubricant composition, the one or more fatty acid alkanolamides (component D in the embodiments above) may be present in amounts of from 0.2 to 3 wt %, e.g., 0.2 to 1.5 wt %, based on the total weight of the lubricant composition. In many embodiments where D is present, the combination of components C and D is from about 0.4 to 3 wt %, and the weight ratio of C:D is from 5:1 to 1:5. In some embodiments, the weight ratio of C:D is from 3:1 to 1:3 or from 1:1.1 to 1:5.

Also provided is a method of preventing or reducing the occurrence of Low Speed Pre-Ignition (LSPI) comprises the step of lubricating the crankcase of the engine with a lubricating oil composition as disclosed herein.

The preceding summary is not intended to restrict in any way the scope of the claimed invention. In addition, it is to be understood that both the foregoing general description and the following detailed description are exemplary and explanatory only and are not restrictive of the invention, as claimed.

DETAILED DESCRIPTION

Figure 1:
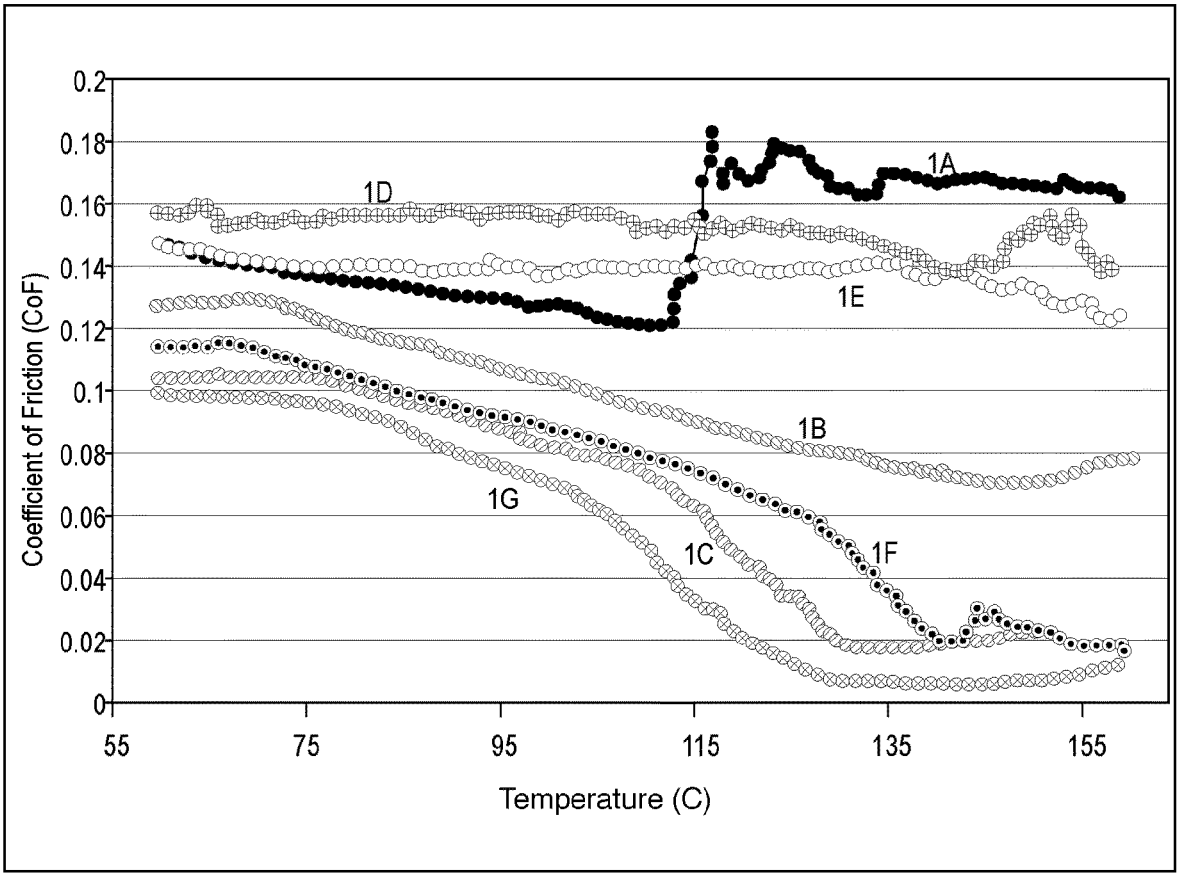
FIG. 1 is a chart showing the Coefficient of Friction at various temperatures for base oils containing magnesium or calcium sulfonate detergents and for base oils containing magnesium sulfonate detergents and a combination of alkanolamide and molybdenum friction modifiers.

Unless otherwise specified, the word "a" or "an" in this application means "one or more than one."

The lubricant compositions of the present disclosure solve the problems associated with the high friction encountered when magnesium detergents replace calcium detergents (for preventing or reducing LSPI) by providing excellent friction reduction, even at extremely low levels of molybdenum.

For example, the mixed thio acid amide molybdenum dithiocarbamate complexes of the present disclosure show much stronger than expected friction reduction in comparison to other commercial molybdenum based friction modifiers, including other molybdenum dithiocarbamate friction modifiers, in engine oils formulated with magnesium and overbased magnesium detergents. In order to achieve the results of the presently disclosed lubricant compositions, other commercial molybdenum friction modifiers tested required higher concentrations of additive, which increases the overall concentrations of metals in the oil, which is less desirable due to resulting increase of levels of particulates and ash detrimental to engine emissions.

Further, synergistic friction reducing activity was observed with the further addition of the presently disclosed fatty acid alkanolamides, which allows for a reduction in the amount of molybdenum based friction reducing additive employed. This synergistic effect greatly increases the flexibility in choosing a molybdenum based friction reducing additive for the lubricant composition, as the combination produces excellent friction reduction activity and allows for significantly reduced molybdenum levels.

In one aspect of the present disclosure, a lubricant composition comprises:

A) a lubricating oil, e.g., a base oil;

B) a magnesium detergent or overbased magnesium detergent; and

C) one or more molybdenum dithiocarbamates represented by the formula:

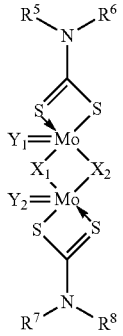

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group, and $X_1$, $X_2$, $Y_1$, and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$ and $R^8$ are each independently chosen from a $C_{12}$ hydrocarbyl group terminating in a $C_{9-19}$ (e.g., $C_{13-17}$) alkyl or alkenyl ether or amide. In some embodiments, at least two of the four R groups are the same. In some embodiments, $R^5$ and $R_8$ are the same and $R_6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl ether, and at least one other R (e.g., the other of $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl amide.

In some embodiments, each of $R^5$, $R^6$, $R^7$, and $R^8$ is independently chosen from 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R^5$, $R^6$, $R^7$, and $R^8$ may each have $C_6$ to $C_{18}$ alkyl groups.

$X_1$ and $X_2$ may be the same, and $Y_1$ and $Y_2$ may be the same. For example, $X_1$ and $X_2$ may both comprise sulfur atoms, and $Y_1$ and $Y_2$ may both comprise oxygen atoms.

In some embodiments, the lubricating composition comprises from about 0.2 to about 6.0 wt %, e.g., from about 0.3 to about 4 wt % or about 0.5 to about 2 wt %, based on the total weight of the lubricant composition, of the magnesium detergent or overbased magnesium detergent (component B), and from 0.2 to 3 wt %, e.g., about 0.2 to about 1.5 wt %, based on the total weight of the lubricant composition, of the one or more molybdenum dithiocarbamates (component C).

In another aspect of the present disclosure, a lubricant composition comprises:

A) a lubricating oil, e.g., a base oil;

B) a magnesium detergent or overbased magnesium detergent; and

C) a mixed molybdenum thio acid amide dithiocarbamate comprising the reaction product of:

(a) an unsaturated or saturated ester or acid, (b) a diamine of the formula:

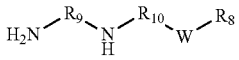

wherein $R_8$ is an akyl group of 1 to 40 carbon atoms, $R_9$ and $R_{10}$ are independently selected aliphatic or aromatic moieties, and W is oxygen, sulfur, or —$CH_2$—;

(c) carbon disulfide, and (d) a molybdenum compound, such as molybdic acid, ammonium molybdate, molybdenum salts, such as $MoOCl_4$, $MoO_2Br_2$, $Mo_2O_3Cl_6$, and $MoO_3$, and their thio analogues, such as $MoS_3$ and $(NH_4)_2MoS_4$.

The unsaturated or saturated ester or acid may be a mono- or polyfunctional organic acid or ester of the formula:

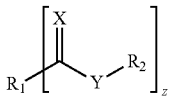

wherein $R_1$ is a straight chain or branched chain or cyclic, saturated or unsaturated, hydrocarbon moiety of 1 to 44, e.g., 1 to 19, carbon atoms, $R_2$ is hydrogen, a hydrocarbon radical, or a functionalized hydrocarbon radical, typically having 1 to 18 carbon atoms, Z is an integer of 1 to 5, e.g., 1 to 4, and X and Y are independently selected from the group consisting of sulfur and oxygen.

In some embodiments, $R_1$ is a straight or branched chain, fully saturated or partially unsaturated hydrocarbon moiety of 1 to 44 carbon atoms. For example, $R_1$ may be methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof. Additionally, contained within the chains of $R_1$ may be ester groups or heteroatoms, such as oxygen and sulfur, which may take the form of ethers, poly ethers, and/or sulfides.

Natural materials may be conveniently employed in the preparation of the molybdenum additive, e.g., mono-, di-, and tri-glycerides from fats and oils, such as vegetable oils may be used, which are themselves typically mixtures lending to the complexity of the product mixture.

Preparation of the molybdenum dithiocarbamates may begin with the reaction of a carboxylic acid or ester with a diamine, typically in a molar ratio of, e.g., 1:2 to 2:1 of amine to acid/ester, often at elevated temperature, e.g., from 90 to 200° C. To the product formed is added $CS_2$, and then the molybdenum compound, e.g., $MoO_3$, followed by heating if necessary, e.g., from 70 to 140° C. Additional detail can be found in, e.g., U.S. Pat. No. 6,103,674. U.S. Pat. No.

6,103,674 is incorporated herein by reference for its disclosure of molybdenum based friction reducing additives and methods of preparing the same.

Carboxylic acids that can be used in the production of a molybdenum based additive suitable for the present disclosure include $C_{2-45}$, e.g., $C_{2-24}$, $C_{6-20}$, or $C_{8-18}$, straight chain, branched chain or cyclic alkanoic or alkenoic mono-, di- tri-, or tetra-carboxylic acids, which may be substituted by OH or interrupted by oxygen. For example, some mono-carboxylic acids useful in the disclosure include acetic, propionic, butyric, pentanoic, hexanoic, heptanoic, ethylhexanoic, octanoic, nonanoic, decanoic, dodecanoic, myristic, palmitic, stearic, arachidonic, and unsaturated analogues, such as hexenoic, decanoic, myristoleic, oleic, linoleic, and the like. Useful di-carboxylic acids include, e.g., malonic, succinic, glutaric, adipic, pimelic, suberic, azelaic, sebacic, and the like.

Useful esters include esters based on the preceding acids with $C_{1-45}$, e.g., $C_{1-12}$ or $C_{1-4}$, straight chain, branched chain or cyclic, alkyl or alkenyl alcohols, diols, triols, or tetrols, pentols or hexols, including ether containing alcohols, such as diethylene glycol.

For example, some useful esters include methyl, ethyl, propyl, iso-propyl, butyl, iso-butyl, t-butyl, pentyl, hexyl, 2-ethyl hexyl, heptyl, octyl, nonyl, decyl, undecyl, dodecyl, tetradecyl, hexadecyl, octadecyl or oleyl esters of the acids above, e.g., methyl, ethyl, propyl, iso-propyl, butyl, iso-butyl, t-butyl esters. Useful esters from polyols include those formed from the acids above and diols, such as ethylene glycol or propanediol, triols, such as glycerol, or tetrols, such as pentaerythritol.

More than one carboxylic acid or ester may be used, and in some embodiments, both carboxylic acids and esters are used.

In one embodiment, a vegetable oil is used as the source of the carboxylic acid and or esters. Vegetable oils generally contain a mixture of triglycerides. Naturally occurring vegetable oils include, e.g., canola oil, corn oil, coconut oil, sunflower oil, soybean oil, lard, palm oil, etc. For example, canola oil comprises a mixture of esters comprising as the alcohol portion glycerol, and as the carboxylic acid portion oleic acid, linoleic acid and smaller quantities of palmitic and stearic acid.

Certain specific esters useful in the preparation include but are not limited to ethylene glycol dioleate, propylene glycol dioleate, butanediol dioleate, glycerol monooleate, glycerol linoleate, glycerol linolenate, glycerol trioleate, pentaerythritol tetraoleate, pentaerythritol trioleate monomyristate, trimethylol propane trioleate, trimethylol propane dioleate monomyristate, trimethylol propane dilinoleate monooleate, and the like, and dibasic esters, such as dioleyl adipate, dioleyl sebacate, dioleyl maleate, dioleyl succinate, dilinoleyl adipate, and the like. Mixtures of such esters, and others similar thereto, are also useful.

The above acids and/or esters may be reacted with one or more amines, such as amines exemplified by the formula:

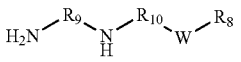

wherein $R_8$ is an alkyl group of 1 to 40 carbon atoms, $R_9$ and $R_{10}$ are independently selected aliphatic or aromatic moieties, and W is oxygen, sulfur, or —$CH_2$—. The diamine may be used in a concentration of about 10 weight percent to about 70 weight percent.

$R_8$ can be an alkyl moiety of 1 to 40, e.g., 8 to 24, carbon atoms and can have either a straight chain or a branched chain, a fully saturated or partially unsaturated hydrocarbon chain, e.g., methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof. Additionally, Re can contain within its chain ester groups or heteroatoms, such as oxygen and sulfur, which can take the form of ethers, polyethers, and/or sulfides.

$R_9$ and $R_{10}$ in the above formula, independently, can be aliphatic or aromatic moieties, generally aliphatic, e.g., alkylene, such as ethylene, propylene, or isopropylene. In many embodiments, $R_9$ and $R_{10}$ are independently selected from the group consisting of ethylene and propylene, and often $R_9$ and $R_{10}$ are each propylene.

Some polyamines useful in the present disclosure are commercially available, including, e.g.:

octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, and N-oleyl-1,3-diaminopropane.

The product from the acid and/or ester and amine above can be reacted with carbon disulfide and then a molybdenum compound (e.g., molybdenum trioxide). The molybdenum compound may be used in a concentration of, e.g., about 0.01 to about 15 wt %.

For example, in some embodiments, the mixed molybdenum thio acid amide dithiocarbamate is the reaction product of (a) a vegetable oil; (b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane; (c) carbon disulfide; and (d) $MoO_3$.

In some embodiments, the lubricating composition comprises from about 0.2 to about 6.0 wt %, e.g., from about 0.3 to about 4 wt % or about 0.5 to about 2 wt %, based on the total weight of the lubricant composition, of the magnesium detergent or overbased magnesium detergent (component B), and from 0.2 to 3 wt %, e.g., about 0.2 to about 1.5 wt %, based on the total weight of the lubricant composition, of the mixed thio acid amide molybdenum dithiocarbamate (component C).

Lubricants containing magnesium detergents and overbased magnesium detergents have less problems with LSPI than lubricants containing calcium detergents and overbased calcium detergents. The molybdenum dithiocarbamates of the present disclosure, e.g., the mixed thio acid amide molybdenum dithiocarbamates, are more effective at reducing friction in lubricants containing magnesium detergents and overbased magnesium detergents than other molybdenum based friction modifiers. Due to the excellent activity, and relatively low Mo content, of these molybdenum dithiocarbamates, the present lubricant composition reduces LSPI and exhibits low friction without an increase in the amount of ash producing metal.

Additional low friction performance, or further reduction in molybdenum, can be achieved with lubricant compositions further comprising:

D) one or more fatty acid 2-hydroxyalkylamide, i.e., alkanolamide, compounds of formula I:

I

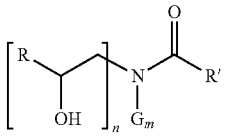

wherein n is 1 or 2; when n is 1, m is 1; when n is 2, m is 0,

R is H or $C_{1-12}$ alkyl (such as $C_{1-8}$ alkyl or $C_{1-4}$ alkyl, e.g., methyl or ethyl), G is H or $C_{1-6}$ alkyl, and R' is selected from $C_{7-23}$ alkyl or alkenyl (e.g., $C_{7-19}$ alkyl or alkenyl, or $C_{9-19}$ alkyl or alkenyl).

In some embodiments, the one or more fatty acid alkanolamide compounds have a structure according to formula II:

II

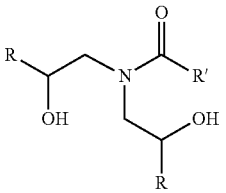

wherein R is H or $C_{1-12}$ alkyl (such as $C_{1-6}$ alkyl or $C_{1-4}$ alkyl, e.g., methyl or ethyl); and R' is selected from $C_{7-23}$ alkyl or alkenyl (e.g., $C_{7-19}$, alkyl or alkenyl, or $C_{9-19}$ alkyl or alkenyl).

The lubricating composition may comprise, e.g., from about 0.2 to about 3.0 wt %, such as about 0.2 to about 1.5 wt %, based on the total weight of the lubricant composition, of the one or more fatty acid alkanolamides (component D).

Also provided is a lubricant composition comprising:

A) a lubricating oil, e.g., a base oil;

B) a magnesium detergent or overbased magnesium detergent;

C) a molybdenum based friction reducing additive; and

D) one or more fatty acid alkanolamide compounds of formula I:

I

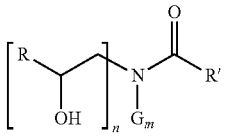

wherein n is 1 or 2; when n is 1, m is 1; when n is 2, m is 0,

R is H or $C_{1-12}$ alkyl (such as $C_{1-8}$ alkyl or $C_{1-4}$ alkyl, e.g., methyl or ethyl), G is H or $C_{1-6}$ alkyl, and R' is selected from $C_{7-3}$ alkyl or alkenyl (e.g., $C_{7-19}$, alkyl or alkenyl, or $C_{9-19}$ alkyl or alkenyl).

In some embodiments, the one or more fatty acid alkanolamide compounds have a structure according to formula II:

II

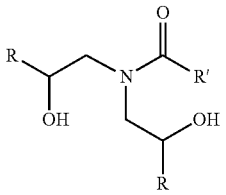

wherein R is H or $C_{1-12}$ alkyl (such as $C_{1-8}$ alkyl or $C_{1-4}$ alkyl, e.g., methyl or ethyl); and R' is selected from $C_{7-3}$ alkyl or alkenyl (e.g., $C_{7-19}$, alkyl or alkenyl, or $C_{9-19}$, alkyl or alkenyl).

In accordance with the present disclosure, synergy is observed when the molybdenum component C and the fatty acid alkanolamide D are present, allowing for yet a further decrease in molybdenum in the composition, as portions of the molybdenum containing compound can be replaced by the fully organic amide without loss of friction reducing activity. In this regard, U.S. Provisional Patent Application Nos. 62/572,945 and 62/723,093, filed Oct. 16, 2017, and Aug. 27, 2018, respectively, and co-pending International Patent Application No. PCT/US18/55850, filed Oct. 15, 2018, are incorporated herein by reference.

While not wanting to be bound by theory, it is believed that the nature of the alkanolamide chemical structure, as described herein, with the polar hydroxyalkyl amide functionality and non-polar long chain may aid its miscibility with the molybdenum based friction reducing additive as the tribofilm is developed. This organic FM may thereby intimately contribute to overall friction reduction by adding its dynamic chemisorption self-assembly friction reduction layers to further enhance and fortify the glass type Molybdenum disulfide ($MoS_2$) tribofilm glass formed after thermal activation. In addition, the hydroxyamide functionality may serve to further react with any Molybdenum oxide formation to generate a new ester amide type Mo complex FM species to further reduce any increase in friction. Such complexes of fatty ester amides with Mo may act as organo-molybdenum friction modifiers.

In some embodiments, the lubricating composition comprises from about 0.2 to about 6.0 wt %, e.g., from about 0.3 to about 4 wt % or about 0.5 to about 2 wt %, based on the total weight of the lubricant composition, of the magnesium detergent or overbased magnesium detergent (component B), from 0.2 to 3 wt %, e.g., about 0.2 to about 1.5 wt %, based on the total weight of the lubricant composition, of the molybdenum based friction reducing additive (component C), and from about 0.2 to about 3 wt %, e.g., about 0.2 to about 1.5 wt %, based on the total weight of the lubricant composition, of the one or more fatty acid alkanolamides (component D).

In many embodiments, the combination of components C and D is from about 0.4 to about 3 wt %. The weight ratio of component C to component D may be from 5:1 to 1:5, e.g., 5:1, 4:1, 3:1, 2:1, 1.5:1, 1:1, 1:1.5, 1:2, 1:3, 1:4, or 1:5 or any weight ratio therebetween. For example, the weight ratio of the molybdenum based friction reducing additive to the one or more fatty acid alkanolamides may be from 4:1 to 1:4, from 3:1 to 1:3, from 2.5:1 to 1:2.5, from 2:1 to 1:2, from 1.5:1 to 1:1.5, or 1:1. In some embodiments, the weight ratio of component C to component D is from 1:1 to 1:5, such as 1:1.1 to 1:5, 1:1.2 to 1:4, 1:1.5 to 1:4, or 1:1.5 to 1:3.

In certain embodiments, the one or more fatty acid alkanolamides are two or more compounds of formula II, wherein R is methyl, and about 15 to about 45% by weight of the alkanolamides are compounds where R' is $C_{15}$ alkyl or alkenyl, about 40 to about 80% by weight of the alkanolamides are compounds where R' is $C_{17}$ alkyl or alkenyl, and 0 or 0.1 to about 15% by weight of the alkanolamides are compounds where R' is $C_{7-14}$, $C_{16}$ or $C_{18-19}$ alkyl or alkenyl.

The alkanolamides of the present disclosure may be prepared by known methods, e.g., reaction between an alkanol amine and a carboxylic acid or carboxylic acid derivative e.g., an ester, acid chloride, etc. Mixtures of compounds are conveniently prepared by using more than one alkanol amine and/or more than one carboxylic acid or carboxylic acid derivative during the reaction, although one can prepare individual amides and blend them.

In some embodiments, at least one fatty acid alkanolamide is a compound of formula (I) or (II) wherein R is selected from $C_{1-12}$ alkyl, such as $C_{1-8}$ alkyl or $C_{1-4}$ alkyl, e.g., methyl or ethyl. Exemplary fatty acid alkanolamides of formulas (I) and (II), suitable mixtures of such alkanolamides, and methods of preparing the same are found in U.S. Pat. No. 9,562,207 and US 2016/0251591, which are incorporated herein by reference.

$C_{7-23}$ alkyl or alkenyl (e.g., $C_{7-19}$ alkyl or alkenyl, or $C_{9-19}$ alkyl or alkenyl) represents a straight or branched chain of the designated number of carbon atoms, which is fully saturated in the case of alkyl or contains one or more carbon-carbon double bonds in the case of alkenyl.

$C_{1-6}$ alkyl and $C_{1-12}$ alkyl (such as $C_{1-8}$ alkyl or $C_{1-4}$ alkyl) represent a straight or branched fully saturated chain of the designated number of carbon atoms, e.g., methyl, ethyl, propyl, isopropyl, butyl, sec-butyl, iso-butyl, tert-butyl, pentyl, sec-pentyl, tert-pentyl, hexyl, methylpentyl, ethyl butyl, etc.

The two R groups in formula I (where n is 2) or formula II may be the same or different. For example, each R may be independently selected from H, methyl, ethyl, propyl, isopropyl, butyl, sec-butyl, iso-butyl and tert-butyl. In some embodiments R is methyl or ethyl. In certain embodiments, each R is methyl.

In many embodiments, a mixture of alkanolamides is used. For example, a mixture of compounds of formula I or formula II differing at R' may be employed. In such mixtures, for example, at least one compound of formula I or II where R' is $C_{15}$ alkyl or alkenyl and at least one compound of formula I or II where R' is $C_{17}$ alkyl or alkenyl may be present. In some embodiments the majority of R' groups in the mixture are selected from $C_{13}$, $C_{15}$ and $C_{17}$ alkyl or alkenyl (which correlate with products derived from $C_{14}$, $C_{16}$ and $C_{18}$ fatty acids), for example, in some embodiments, the majority of R' groups in the mixture are $C_{15}$ and/or $C_{17}$ alkyl or alkenyl. In many embodiments, both alkyl and alkenyl groups are present at R' in the amide mixtures.

There are variety of natural sources for the carboxylic acid or derivative used in the preparation of the alkanolamides, e.g., fats and oils, such as canola oil, corn oil, coconut oil, sunflower oil, soybean oil, lard, palm oil, beef tallow, cocoa butter, illipe, which provide mixtures of carboxylic acids and derivatives. The carboxylic acids or carboxylic acid derivatives may be reacted with a di(hydroxyalkyl) amine. U.S. Pat. No. 9,562,207 has shown particular value in preparing friction reducing alkanolamides from bis(2-hydroxypropyl)amine and methyl esters derived from beef tallow carboxylates, and these amides work exceedingly well in the present disclosure. Other alkanolamides from other carboxylates or mixtures of carboxylates similarly provide excellent benefits when blended with the molybdenum based friction reducing additive according to the instant disclosure.

The carboxylate groups of fats and oils are often present as esters. For example, beef tallow contains esters, such as glycerides, diglycerides, triglycerides etc., of palmitic acid (saturated $C_{16}$ acid), stearic acid (saturated $C_{18}$ acid), oleic acid (mono-unsaturated $C_{18}$ acid) and smaller amounts of poly-unsaturated $C_{18}$ acids and other fatty acids. Thus, using beef tallow as the source of the alkylcarboxy portion of the alkanolamides provides a mixture of predominately palmitic, stearyl and oleic amides, i.e., compounds of formula II wherein R' is $C_{15}$ alkyl, $C_{17}$ alkyl and $C_{17}$ alkenyl.

It is possible to use the natural source as it is obtained, for example, a mixture of glycerides, or the natural mixture of products can be hydrolyzed to a fatty acid mixture or otherwise transformed, e.g., transesterified with a smaller alcohol, prior to use. For example, a tallow triglyceride can be reacted with methanol to provide a mixture of methyl tallowate esters which can be reacted with the desired amine; the tallow triglyceride can be hydrolyzed to a tallow acid mixture and then reacted with the amine; or the triglyceride can be directly reacted with amine. Each of these methods can be used to prepare the same, or roughly the same amide mixture, however, processing conditions and side products will vary.

In some embodiments, the mixture of alkanolamides of the present disclosure comprises compounds of formula I or II wherein about 15 to about 45% by weight of the alkanolamides are compounds where R' is $C_{15}$ alkyl or alkenyl, about 40 to about 80% by weight of the alkanolamides are compounds where R' is $C_{17}$ alkyl or alkenyl, and 0 or 0.1 to about 15%, or 2 to 15%, by weight of the alkanolamides are compounds where R' is $C_{7-14}$, $C_{16}$ or $C_{18-19}$ alkyl or alkenyl;

for example, wherein about 20 to about 35% by weight of the alkanolamides are compounds where R' is $C_{15}$ alkyl or alkenyl, about 50 to about 75% by weight of the alkanolamides are compounds where R' is $C_{17}$ alkyl or alkenyl, and 0 to about 15%, or 2 to 15%, by weight of the alkanolamides are compounds where R' is $C_{7-14}$, $C_{16}$ or $C_{18-19}$ alkyl or alkenyl, in some embodiments, 0 or 2 to about 15% by weight of the alkanolamides are compounds where R' is $C_{9-14}$, $C_{16}$ or $C_{18-19}$ alkyl or alkenyl.

In some embodiments, about 30 to about 70% by weight of the alkanolamides are compounds where R' is $C_{7-19}$ alkyl and about 30 to about 70% by weight are compounds where R' is $C_{7-19}$, alkenyl.

In some embodiments, the mixture of amides comprises compounds of formula I or II wherein about 15 to about 45%, for example, about 20 to about 35%, by weight of the alkanolamides are compounds where R' is $C_{15}$ alkyl or alkenyl wherein a majority, for example, about 75% or more, 90% or more, or 95% or more of the $C_{15}$ alkyl or alkenyl are alkyl;

about 40 to about 80%, for example, about 50 to about 75%, by weight of the alkanolamides are compounds where R' is $C_{17}$ alkyl or alkenyl, wherein about 40 to about 95% of said $C_{17}$ alkyl or alkenyl are alkenyl; and 0 or 1 to about 15% by weight of the alkanolamides are compounds where R' is $C_{7-14}$, $C_{16}$ or $C_{18-19}$ alkyl or alkenyl, for example, $C_{9-14}$, $C_{16}$ or $C_{18-19}$ alkyl or alkenyl.

In some embodiments, about 15 to about 45% of the alkanolamides are compounds wherein R' is fully saturated $C_{15}$ alkyl, and a portion of the alkanolamides are compounds where R' as $C_{17}$ are saturated akyl and a portion are alkenyl. In many embodiments about 20 to about 35% by weight of the alkanolamides are compounds wherein R' is fully saturated $C_{15}$ alkyl and both $C_{17}$ alkyl and $C_{17}$ alkenyl as R' are present.

The molybdenum based friction reducing additive may be prepared according to known methods. The molybdenum additive may comprise a mixture of molybdenum based compounds.

In some embodiments, the molybdenum based friction reducing additive comprises one or more compounds of the formula $Mo(ROCS_2)_4$ and/or the formula $Mo(RSCS_2)_4$, wherein R is an organo group selected from the group consisting of alkyl, aryl, aralkyl and alkoxyalkyl, generally of from 1 to 30 carbon atoms, such as 2 to 12 carbon atoms, e.g., alkyl of 2 to 12 carbon atoms.

In some embodiments, the molybdenum based friction reducing additive comprises a molybdenum dithiocarbamate or mixture thereof, such as any of those described above.

Additional examples of suitable molybdenum dithiocarbamates are represented by the formula:

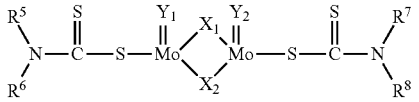

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group; and $X_1$, $X_2$, $Y_1$, and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$, and $R^8$ are each independently chosen from a $C_{3-12}$ hydrocarbyl group terminating in a $C_{9-19}$ (e.g., $C_{13-17}$) alkyl or alkenyl ether or amide. In some embodiments, at least two of the four R groups are the same. In some embodiments, $R^5$ and $R^6$ are the same and $R^6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl ether, and at least one other R (e.g., the other of $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl amide.

Other examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R^5$, $R^6$, $R^7$, and $R^8$ may each have $C_6$ to $C_{18}$ alkyl groups. $X_1$ and $X_2$ may be the same, and $Y_1$ and $Y_2$ may be the same. For example, $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates, such as dibutyl-, diamyl-di-(2-ethylhexyl)-, dilauryl-, dioleyl-, and dicyclohexyl-dithiocarbamate.

Additional examples of suitable molybdenum dithiocarbamates are represented by the following dinuclear and trinuclear formulas, respectively:

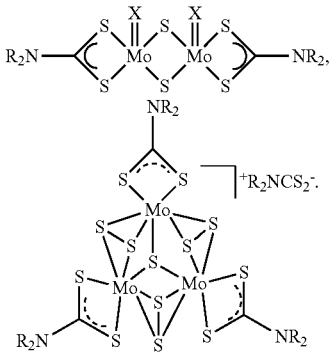

In the dinuclear formula, X may be oxygen or sulfur. In both formulas, R may be $C_{1-20}$ alkyl or alkenyl, or $C_{6-20}$ cycloalkyl, aryl, alkylaryl, or aralkyl. Exemplary R groups include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Each R group may, but need not be, the same.

Further examples of suitable molybdenum dithiocarbamates are represented by the formula:

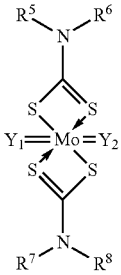

wherein $R^5$, $R^6$, $R^7$, and $R^8$ each independently represent a hydrogen atom, a $C_{1-20}$ alkyl or alkenyl group, a $C_{6-20}$ cycloalkyl, aryl, alkylaryl, or aralkyl group, or a $C_{3-20}$ hydrocarbyl group (e.g., a $C_{3-12}$ or $C_{3-6}$ hydrocarbyl group) containing (e.g., terminating in) an ester, ether, alcohol, amine, amide or carboxyl group; and $Y_1$ and $Y_2$ each independently represent a sulfur or oxygen atom. The ester, ether, amine, amide, or carboxyl group may be an alkyl or alkenyl ester, ether, amine, amide, or carboxyl group, e.g., $C_{1-30}$, $C_{5-25}$, $C_{9-19}$, or $C_{13-17}$ alkyl or alkenyl ester, ether, amine, amide, or carboxyl group. In some embodiments, $R^5$, $R^6$, $R^7$, and $R^8$ are each independently chosen from a $C_{3-12}$ hydrocarbyl group terminating in a $C_{9-19}$ (e.g., $C_{13-17}$) alkyl or alkenyl ether or amide. In some embodiments, at least two of the four R groups are the same. In some embodiments, $R^5$ and $R^8$ are the same and $R^6$ and $R^7$ are the same. In some embodiments, each R is the same.

In further embodiments, at least one R (e.g., $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl ether, and at least one other R (e.g., the other of $R^5$ and $R^8$ or $R^6$ and $R^7$) is a $C_{3-20}$ hydrocarbyl group (e.g., a $C_{3-12}$ or $C_{3-6}$ hydrocarbyl group) containing (e.g., terminating in) a $C_{1-30}$, $C_{5-25}$, $C_{9-19}$, or $C_{13-17}$ alkyl or alkenyl amide.

Other examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R^5$, $R^6$, $R^7$, and $R^8$ may each have $C_6$ to $C_{18}$ alkyl groups. $Y_1$ and $Y_2$ may be the same, i.e., $Y_1$ and $Y_2$ may both comprise oxygen atoms or both comprise sulfur atoms.

Additional examples of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds, such as water, amines, alcohols, phosphines, and ethers, and z ranges from 0 to 5 and includes non-stoichiometric values. At least 21 total carbon atoms may be present among all the ligands' organo groups, or at least 25, at least 30, or at least 35 carbon atoms. Additional suitable molybdenum compounds are described in U.S. Pat. No. 6,723,685.

In some embodiments, the molybdenum friction reducing additive comprises one or more molybdenum dithiophosphates.

One example of suitable molybdenum dithiophosphates is represented by the formula:

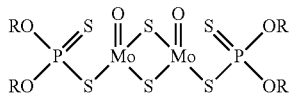

wherein R is $C_1$ to $C_{20}$ alkyl or alkenyl (e.g., $C_6$ to $C_{18}$ alkyl or alkenyl). Examples of suitable groups for R include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, and linoleyl. In some embodiments, the molybdenum species are bridged.

Further examples of molybdenum compounds which may be used include commercial materials sold as Molyvan® 822, Molyvan® A, Molyvan® L, Molyvan® 2000, and Molyvan® 855, Adeka Sakura-Lube S-100, S-165, 5-200, S-300, S-310G, S-525, S-600, 5-700, and S-710, ADDITIN® 3580, and mixtures thereof.

Suitable magnesium detergents or overbased magnesium detergents include those comprising salts selected from magnesium sulfonates, magnesium salicylates, magnesium phenates, and other related components (including borated detergents), and mixtures thereof. Often, overbased detergents are used. More than one magnesium detergent or overbased magnesium detergent may be present.

In many embodiments, one or more magnesium sulfonate or overbased magnesium sulfonate detergents are used. Such sulfonate detergents can be based on natural sulfonates or synthetic sulfonates. For example, the magnesium detergent may comprise one or more alkyl substituted aromatic hydrocarbon (i.e., alkylaryl) sulfonates, such as those obtained from the fractionation of petroleum or by the alkylation of aromatic hydrocarbons. Natural sulfonic acids used in the preparation of sulfonates are typically prepared by sulfonation of suitable petroleum fractions. Natural sulfonates may contain a small amount of polycyclic species. Synthetic sulfonates tend to be monocyclic species, often mono- or di-alkylated.

Suitable examples of alkylaryl include alkylated (e.g., mono-alkylated, di-alkylated) benzene, toluene, xylene, naphthalene, anthracene, biphenyl, etc., and their halogen derivatives, such as chlorobenzene, chlorotoluene, and chloronaphthalene. Additional examples include heterocyclic compounds, such as pyridine, indole, isoindole, etc. The alkylation may be carried out in the presence of a catalyst with alkylating agents having from about 3 to more than 70 carbon atoms. In various embodiments, the alkylaryl sulfonates contain from about 9 to about 80 or more carbon atoms per alkyl substituted aromatic moiety, such as from about 16 to about 60 carbon atoms per alkyl substituted aromatic moiety. The alkyl group(s) of the alkyl substituted aromatic moiety may be linear or branched.

As understood in the art, sulfonate detergents may be prepared from oil soluble sulfonic acids, which may be obtained by the sulfonation of, e.g., petroleum fractions or alkylaryl groups, such as those described herein or known in the art. The oil soluble sulfonates or alkylaryl sulfonic acids may be neutralized with suitable magnesium compounds, such as oxides, hydroxides, alkoxides, carbonates, carboxylates, and borates of magnesium. The amount of metal compound is chosen to achieve the desired TBN of the detergent.

An overbased magnesium detergent of the present disclosure may have a total base number (TBN) of greater than 120 mg KOH/gram, or as further examples, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater, as determined using the method of ASTM D-2896. In some embodiments, the overbased magnesium detergent, e.g., a magnesium sulfonate detergent, has a TBN ranging from about 120 to about 700 mg KOH/gram, or about 250 to about 600 mg KOH/gram, or about 300 to about 500 mg KOH/gram.

In various embodiments, the lubricant composition may contain from about 500 ppm to about 2750 ppm, from about 800 ppm to about 2500 ppm, from about 1000 ppm to about 2500 ppm, from about 1400 ppm to about 2500 ppm, or from about 1600 ppm to about 2250 ppm of magnesium provided by the overbased magnesium detergent, based on a total weight of the lubricant composition.

Figure 4:
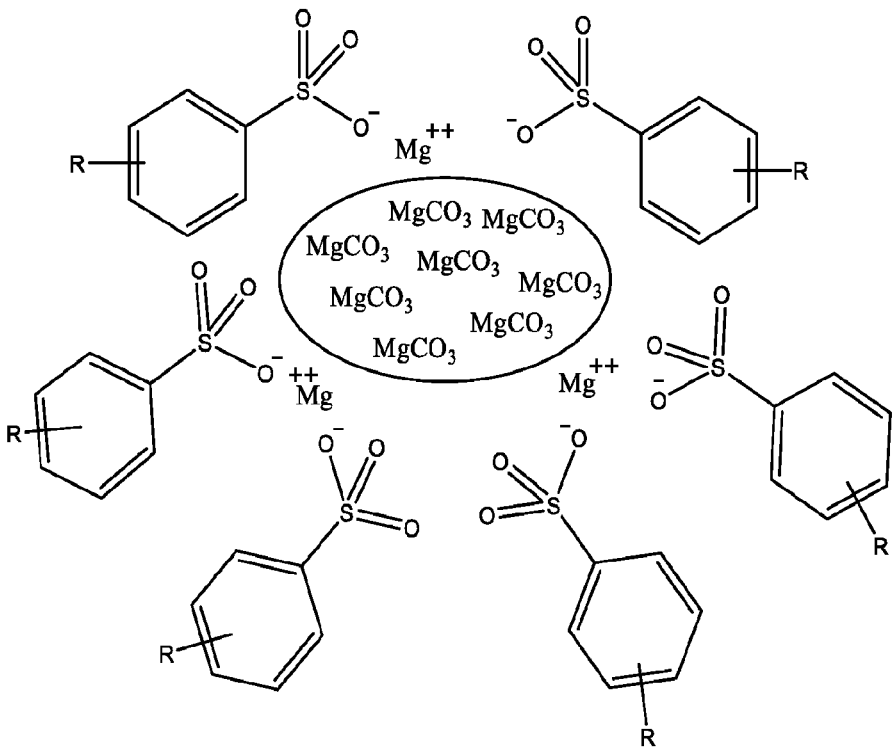
FIG. 4 shows an example of an overbased magnesium detergent micellar system having an inner magnesium carbonate core and an outer magnesium sulfonate soap.

Methods for the preparation of overbased sulfonates are known in the art and can vary considerably, as disclosed, e.g., in US2008/0020955A1, EP3339403A1, US2013/203639A1 and U.S. Pat. No. 4,192,758. Generally speaking, the magnesium detergents can be considered as micro dispersions of oil soluble dispersing agent with considerable amounts of a basic compound for reserve alkalinity. Often, this is an inorganic base and the process of incorporating it into a micelle is termed overbasing. Widely used micellar systems are overbased alkylaryl sulfonates. As discussed herein, they can be magnesium salts of oil soluble alkylaryl sulfonic acids forming a micelle holding magnesium carbonate inorganic base, an example of which is shown in FIG. 4. In addition, any excess $Mg(OH)_2$ developed accounts for free alkalinity.

In some embodiments, the magnesium sulfonate detergent comprises one or more alkybenzene sulfonates of the formula:

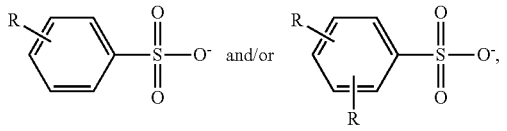

wherein R represents linear or branched alkyl. In various embodiments, the linear or branched alkyl is $C_1$ to $C_{80}$ alkyl, $C_3$ to $C_{60}$ alkyl, $C_3$ to $C_{40}$ alkyl, $C_3$ to $C_{30}$ alkyl, or $C_3$ to $C_{24}$ alkyl.

The reserve alkalinity of the magnesium carbonate salts is referred to as total base number (TBN) which is defined by the acid neutralization power. In general, for example, a 400 TBN detergent has an alkali value (AV) of at least 400 milligrams of KOH per gram equivalent. That is, each gram of 400 TBN overbased sulfonate is generally capable of neutralizing as much acid as 400 milligrams of potassium hydroxide.

In one example, as described in US2013203639A1, an overbased magnesium sulfonate detergent can be made by preparing a mixture of an alkyl aromatic sulfonic acid, excess magnesium oxide, water, a $C_1$-$C_5$ alkanol, a hydrocarbon solvent, and methanol. A combination of promoters such as acetic acid and a polyisobutene succinic anhydride of molecular weight (Mw) 500 to 1500 g $mol^{-1}$ can also be added. The reaction mixture is then charged with carbon dioxide while heating and stirring. During the carbonation reaction the magnesium oxide is ultimately converted into magnesium carbonate resulting in the formation of an overbased magnesium sulfonate.

The art describes many processes suitable for preparing overbased magnesium sulfonates. The methods described may involve various special measures, such as the use of particular reaction conditions and/or incorporation of one or more additional substances into the mixture to be carbonated such as promoters of various types. The use of weak acids as promoters is known in the art, in addition to using specific grades of magnesium oxide, or alternative magnesium compounds. U.S. Pat. Nos. 4,647,387, 4,129,589, and 6,197,075 each describes processes using light-burned MgO, and U.S. Pat. No. 5,534,168 describes a process using hard-burned MgO.

It is possible for calcium detergents or overbased calcium detergents to also be present in the lubricant composition. For example, US 20170015927 discloses a lubricating oil composition comprising a base oil, one or more overbased calcium-containing detergents having a TBN greater than 225 mg KOH/g and one or more magnesium-containing detergents, wherein the total amount of calcium from the one or more overbased calcium-containing detergents is from 900 ppm to less than 2400 ppm by weight, and the total amount of magnesium from the one or more magnesium-containing detergents is from 50 ppm to 500 ppm by weight, based on the total weight of the lubricating oil composition. The lubricating oil composition is said to be effective in reducing low speed pre-ignition events in a boosted internal combustion engine. Such a ratio of Ca:Mg due to the total detergent loading may be encountered in some embodiments of the present disclosure.

In some embodiments, at least 25 wt %, 35 wt %, 40 wt % or 50 wt % of the metal content of a mixture of calcium based detergent and magnesium based detergent in the lubricant composition is magnesium. In some embodiments, more than 50 wt % is magnesium, e.g., 60, 70, 80, 90, or 95 wt % or more is magnesium, and in certain embodiments, no calcium detergents or overbased calcium detergents are present. When a Ca/Mg detergent blend is used, the total amount of the combined detergents may be from 0.2 to about 6.0 wt %, e.g., from about 0.3 to about 4 wt %.

Also disclosed is method of formulating a lubricant composition for reducing or preventing low speed pre-ignition while improving low friction properties. The method comprises providing a lubricating oil comprising one or more naturally occurring base stocks or synthetic base stocks, and adding to the lubricating oil a magnesium detergent or overbased magnesium detergent (component B), a molybdenum component C as described herein, and optionally one or more fatty acid alkanolamides as described herein (component D). Also disclosed is a method for lowering friction in a lubricant composition comprising a magnesium detergent or overbased magnesium detergent. The method comprises adding to the lubricant composition from 0.2 to 3 wt % of a molybdenum component C as described herein, and optionally one or more fatty acid alkanolamides as described herein (component D). The components may be added in the weight percentages and ratios described herein and may be added individually (i.e., as separate components) or collectively (e.g., in a blend or mixture) to the lubricating oil. As will be understood in the art, any or all of the components can be included in an additive package for treating the one or more base stocks. It is also possible to top treat the lubricant composition.

In another aspect, a method of lubricating an internal combustion engine comprises supplying to the engine a lubricant composition according to the present disclosure.

Commercial lubricant formulations typically contain a variety of other additives, for example, dispersants, other detergents, corrosion/rust inhibitors, antioxidants, other anti-wear agents, anti-foamants, other friction modifiers, seal swell agents, demulsifiers, V.I. improvers, pour point depressants, and the like. A sampling of these additives can be found in, for example, U.S. Pat. Nos. 5,498,809 and 7,696,136, the relevant portions of each disclosure is incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions of this disclosure will often contain any number of these additives. Thus, final lubricant compositions of the present disclosure will generally contain a combination of additives, including the inventive friction modifying additive combination along with other common additives, in a combined concentration ranging from about 0.5 to about 30 weight percent, e.g., from about from about 0.5 to about 10 or 15 weight percent based on the total weight of the oil composition. For example, the combined additives are present from about 1 to about 5 or 10 weight percent.

Given the ubiquitous presence of additives in a lubricant formulation, the amount of lubricating oil present in the inventive composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

In one embodiment, a lubricant composition comprises a) from about 70 to about 99.5 wt % of a natural or synthetic lubricating oil base stock, b) from about 0.4 to about 12 wt % (e.g., about 0.4 to about 9 wt %), based on the total weight of the lubricant composition, of components B and C (and D to the extent present), and c) one or more additional lubricant additives selected from the group consisting of dispersants, other detergents, corrosion/rust inhibitors, antioxidants, anti-wear agents, anti-foamants, other friction modifiers, seal Swell agents, demulsifiers, V.I. improvers and pour point depressants, wherein the combined amount of b) and c) present in the composition is from about 0.5 to about 30 weight percent based on the total weight of the lubricant composition. In another embodiment, the lubricating oil base stock is present in the lubricant composition from about 75 to about 90 wt % of the composition and the combined amount of b) and c) is from about 10% to about 25%. In one embodiment the lubricating oil base stock is present in the lubricant composition from about 90 to about 99.5 wt % of the composition and the combined amount of b) and c) is from about 0.5 to about 10 weight percent; and in some embodiments the base stock is present from about 95 to about 99 wt % and the combined amount of b) and c) is from about 1 to about 5 weight percent based on the total weight of the lubricant composition.

The natural or synthetic lubricating oil of the present disclosure can be any suitable oil of lubricating viscosity as described for example in co-pending U.S. application Ser. No. 12/371,872, the relevant portions of which are incorporated herein by reference. For example, a lubricating oil base stock is any natural or synthetic lubricating oil base stock, or mixtures thereof, having a kinematic viscosity at 100° C. of about 2 to about 200 cSt, about 3 to about 150 cSt, and often about 3 to about 100 cSt. Suitable lubricating oil base stocks include, for example, mineral oils, such as those derived from petroleum, oils derived from coal or shale, animal oils, vegetable oils and synthetic oils. The relevant portions of co-pending U.S. application Ser. No. 12/371,872 are incorporated herein by reference.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

The synthetic oils may comprise at least one of an oligomer of an α-olefin, an ester, an oil derived from a Fischer-Tropsch process, and a gas-to-liquid stock. Synthetic base stock lubricating oils include hydrocarbon oils and halo-substituted hydrocarbon oils, such as polymerized and interpolymerized olefins (e.g., polybutylenes, polypropylenes, propylene-isobutylene copolymers, chlorinated polybutylenes, poly(1-hexenes), poly(1 octenes), poly(1-decenes)); alkybenzenes (e.g., dodecylbenzenes, tetradecylbenzenes, dinonybenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process.

In many embodiments, the oil base stock comprises mineral oils. For example, the lubricating oil of the present disclosure may be a petroleum oil, or a mixture comprising a petroleum oil. Many other embodiments include vegetable oils, paraffinic oils, naphthenic oils, aromatic oils, and derivatives thereof, often as combination of base stocks.

Useful base stocks from vegetable and animal sources include, for example, alkyl esters of fatty acids, which include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Often the base stock of lubricating viscosity can comprise a Group I, Group II, or Group III base stock or base oil blends of the aforementioned base stocks, for example, the oil of lubricating viscosity is a Group II or Group III base stock, or a mixture thereof, or a mixture of a Group I base stock and one or more of a Group II and Group III. Generally, a major amount of the oil of lubricating viscosity is a Group II, Group III, Group IV, or Group V base stock, or a mixture thereof. The base stock, or base stock blend, typically has a saturate content of at least 65%, e.g., at least 75% or at least 85%. Most preferably, the base stock, or base stock blend, has a saturate content of greater than 90%.

Definitions for the base stocks and base oils in the present disclosure are the same as those found in the American Petroleum Institute (API) publication "Engine Oil Licensing and Certification System," Industry Services Department (14th ed., December 1996), Addendum 1, December 1998. This publication categorizes base stocks as follows.

(a) Group I base stocks contain less than 90 percent saturates (as determined by ASTM D 2007) and/or greater than 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(b) Group II base stocks contain greater than or equal to 90 percent saturates (as determined by ASTM D 2007) and less than or equal to 0.03 percent sulfur (as determined by ASTM D 2622, ASTM D 4294, ASTM D 4927, and ASTM D 3120) and have a viscosity index greater than or equal to 80 and less than 120 (as determined by ASTM D 2270).

(c) Group III base stocks contain greater than or equal to 90 percent saturates (as determined by ASTM D 2007) and less than or equal to 0.03 percent sulfur (as determined by ASTM D 2622, ASTM D 4294, ASTM D 4927, and ASTM D 3120) and have a viscosity index greater than or equal to 120 (as determined by ASTM D 2270).

(d) Group IV base stocks are polyalphaolefins (PAO).

(e) Group V base stocks include all other base stocks not included in Groups I, 11, 111, or IV.

Further non-limiting disclosure is provided in the Examples that follow.

EXAMPLES

Example 1

In the following tests, a molybdenum dithiocarbamate complex was prepared according to known methods as discussed herein from:

(a) an unsaturated or saturated ester or acid comprising canola oil, (b) ether containing diamine having from 12 to 28 carbons, (c) carbon disulfide, and (d) a molybdenum trioxide.

Fatty acid alkanolamides were prepared as described herein from di-isopropanolamine and carboxylic acid derivatives derived from beef tallow.

FIG. 1 shows the Coefficient of Friction at various temperatures for:

Sample 1A) a Group 111+ base oil (Group III base oil with high viscosity) comprising 1.5 wt % of a commercially available overbased magnesium alkybenzene sulfonate detergent with a TBN of 400;

Sample 1B) the same base oil with 1.5 wt % of an overbased calcium sulfonate detergent with a TBN of 300;

Sample 1C) the base oil/overbased magnesium sulfonate formulation of 1A further containing 1.25 wt % of a 1:1 blend (by weight) of the molybdenum dithiocarbamate complex and fatty acid alkanolamides referenced above;

Sample 1D) the base oil with 1.5 wt % of another commercially available overbased magnesium alkybenzene sulfonate detergent with a TBN of 400;

Sample 1E) the base oil with 1.5 wt % of a third commercially available overbased magnesium alkybenzene sulfonate detergent with a TBN of 400;

Sample 1F) the base oil/overbased magnesium sulfonate formulation of 1D further containing 1.25 wt % of a 1:1 blend (by weight) of the molybdenum dithiocarbamate complex and fatty acid alkanolamides referenced above; and Sample 1G) the base oil/overbased magnesium sulfonate formulation of 1E further containing 1.25 wt % of a 1:1 blend (by weight) of the molybdenum dithiocarbamate complex and fatty acid alkanolamides referenced above.

The different overbased magnesium alkybenzene detergents varied, e.g., in their alkyl groups and sources of materials (e.g., natural or synthetic) relative to one another.

The increase in friction when moving from a calcium sulfonate to a magnesium sulfonate is easily seen in the figure, as is the effectiveness of exemplary embodiments of the present disclosure.

Example 2

Figure 2:
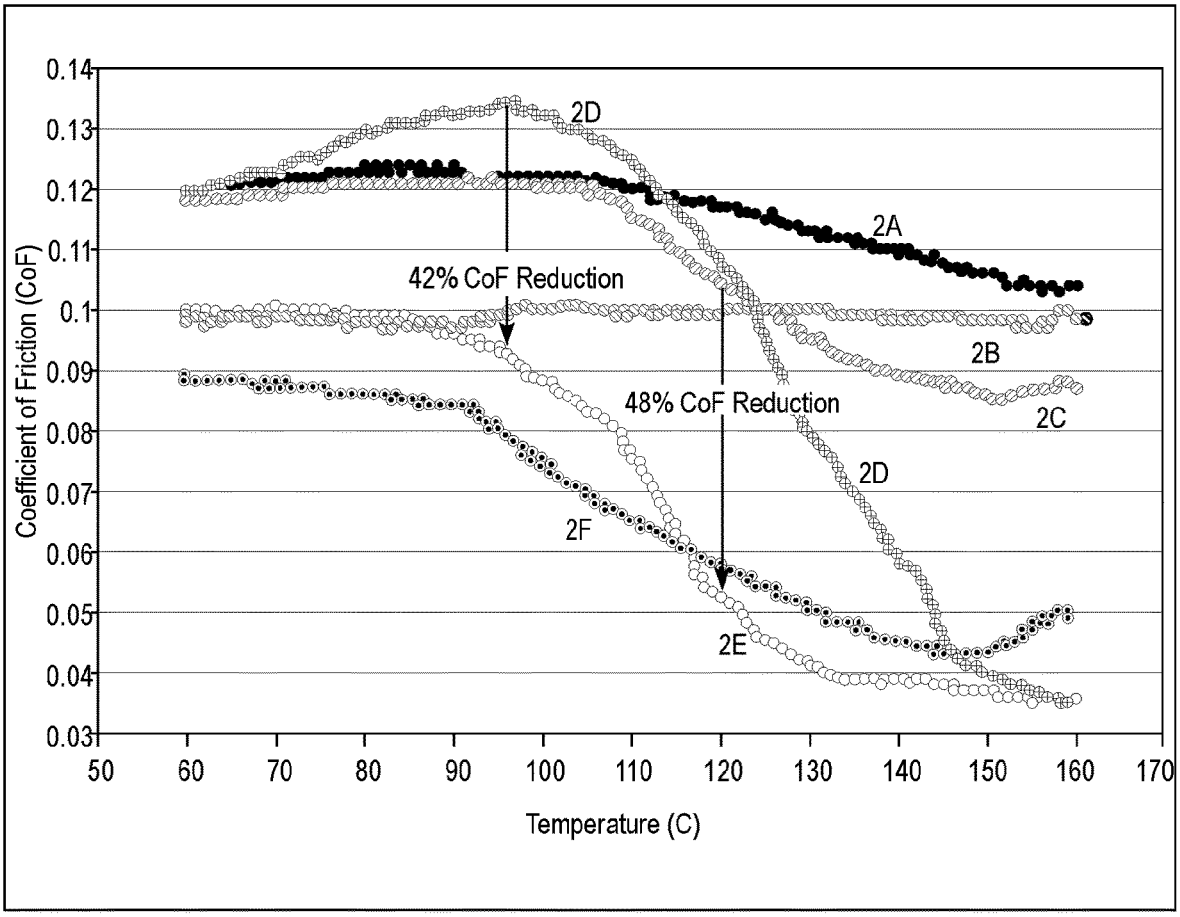
FIG. 2 is a chart showing the Coefficient of Friction at various temperatures for fully formulated oils containing magnesium sulfonate detergent and various molybdenum friction modifiers and for fully formulated oil containing magnesium sulfonate detergent and a combination of alkanolamide and molybdenum friction modifiers.

FIG. 2 shows the Coefficient of Friction at various temperatures for Sample 2A, which was a formulated 5W-30 Group IV containing 1.5 wt % of the overbased magnesium sulfonate from 1A above; formulations of 2A containing 1 wt % (or 0.5 wt % in the case of 2C) of various molybdenum friction modifiers as identified in the table below; and a formulation of 2A containing 1 wt % of a 1:1 mixture (by weight) of the molybdenum dithiocarbamate complex and fatty acid alkanolamides from Example 1. The table below shows the wt % of molybdenum introduced into each sample by the addition of the particular molybdenum additive. The molybdenum friction modifier in Sample 2C was soluble at 0.5 wt %, but gave a hazy composition at 1 wt %. Samples 2B, 2C, and 2D employed commercially available comparative molybdenum friction modifiers, and Sample 2E contained the molybdenum dithiocarbamate complex according to Example 1, and as shown in the table, Sample 2E had a lower molybdenum content than the comparative molybdenum friction modifiers.

Sample 2F contained the 1 wt %, 1:1 mixture (by weight) of the molybdenum dithiocarbamate complex and fatty acid alkanolamides from Example 1.

| Sample | MoFM | wt % Mo in sample |
|---|---|---|
| 2A | — | — |
| 2B (Comparative) | 1 wt % Mo ester | 0.08% |
| 2C (Compartive) | 0.5 wt % Mo thiocarbamate (1 wt % (0.07% Mo in sample) resulted in reduced solubility) | 0.036% |
| 2D (Comparative) | 1 wt % Mo thiocarbamate | 0.05% |
| 2E | 1 wt % MoFM from Example 1 | 0.037% |
| 2F | 0.5 wt % MoFM from Example 1 plus 0.5 wt % alkanolamide from Example 1 | 0.018% |

Of these formulated oil/overbased magnesium sulfonate formulations, Samples 2E and 2F provided excellent results, easily surpassing the activity of Samples 2B, 2C and 2D, even with significantly lower molybdenum levels relative to Samples 2B and 2D. The MoFM/alkanolamide mixture of Sample 2F gave outstanding friction reduction activity at extremely low levels of molybdenum as shown in the table.

Example 3

Figure 3:
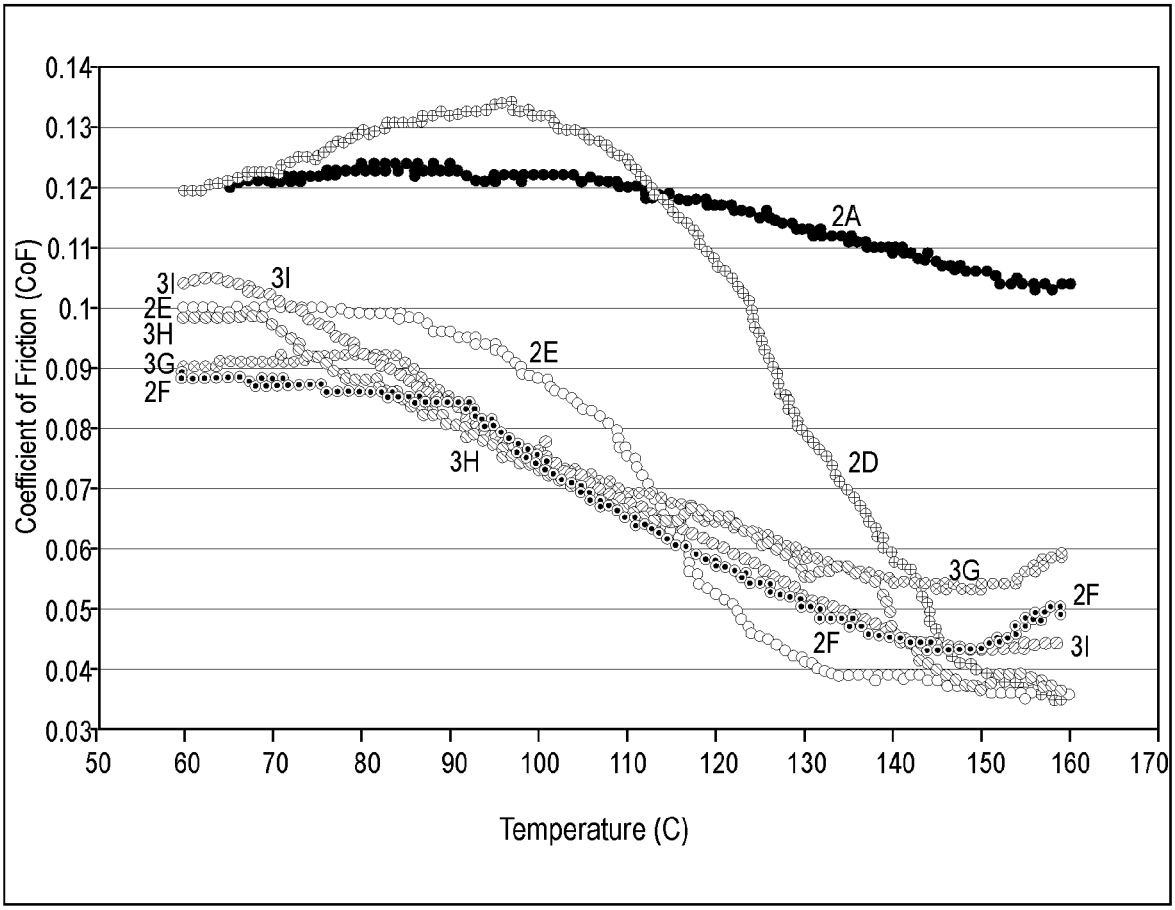
FIG. 3 is a chart showing certain of the data from FIG. 2 and additional Coefficient of Friction data at various temperatures for fully formulated oils containing magnesium sulfonate detergents and either an alkanolamide friction modifier or a combination of alkanolamide and molybdenum friction modifiers.

FIG. 3 includes the data from Samples 2A, 2D, 2E, and 2F from FIG. 2 and also includes:

Sample 3G) the formulation of 2A further comprising 1 wt % of the fatty acid alkanolamides from Example 1;

Sample 3H) the formulated 5W-30 Group IV oil from Example 2, further comprising 1.5 wt % of the overbased magnesium sulfonate detergent used in Sample 1D and 1 wt % of a 1:1 mixture (by weight) of the molybdenum dithiocarbamate complex and fatty acid alkanolamides from Example 1; and Sample 3I) the formulated 5W-30 Group IV oil from Example 2, further comprising 1.5 wt % of the overbased magnesium sulfonate detergent used in Sample 1E and 1 wt % of a 1:1 mixture (by weight) of the molybdenum dithiocarbamate complex and fatty acid alkanolamides from Example 1. The samples are summarized in the following table:

| Sample | MoFM | Mg Sulfonate Detergent | wt % Mo in sample |
|---|---|---|---|
| 2A | — | Same as in 1A | — |
| 2D (Comparative) | 1 wt % Mo thiocarbamate | Same as in 1A | 0.05% |
| 2E | 1 wt % MoFM from Example 1 | Same as in 1A | 0.037% |
| 2F | 0.5 wt % MoFM from Example 1 plus 0.5 wt % alkanolamide from Example 1 | Same as in 1A | 0.018% |
| 3G | — (1 wt % alkanolamide from Example 1; no MoFM) | Same as in 1A | — |
| 3H | 0.5 wt % MoFM from Example 1 plus 0.5 wt % alkanolamide from Example 1 | Same as in 1D | 0.018% |
| 3I | 0.5 wt % MoFM from Example 1 plus 0.5 wt % alkanolamide from Example 1 | Same as in 1E | 0.018% |

The results in the Examples above show that the lubricant compositions of the present disclosure not only solve the problems associated with the high friction encountered when magnesium detergents replace calcium detergent in order to prevent LSPI, but also make possible good friction reduction at very low levels of molybdenum.

For example, the mixed thio acid amide molybdenum dithiocarbamate complexes of the present disclosure show much stronger than expected friction reduction in comparison to other commercial molybdenum based friction modifiers, including other molybdenum dithiocarbamate friction modifiers, in engine oils formulated with magnesium and/or overbased magnesium detergents. In order to achieve the results of the presently disclosed lubricant compositions, other commercial molybdenum friction modifiers tested required higher concentrations of additive, which increases the overall concentrations of metals in the oil, which is less desirable due to resulting increase of levels of particulates and ash detrimental to engine emissions.

Further, synergistic friction reducing activity was observed with the further addition of the presently disclosed fatty acid alkanolamides, which allows for a reduction in the amount of molybdenum based friction reducing additive employed. This synergistic effect greatly increases the flexibility in choosing a molybdenum based friction reducing additive for the lubricant composition, as the combination produces excellent friction reduction activity and allows for significantly reduced molybdenum levels.

Synergistic friction reducing activity of the fatty acid alkanolamides of the present disclosure when combined with one or more molybdenum based friction reducing additives is further exemplified in the following Examples.

Example 4

The friction reducing activity of a combination of the presently disclosed fatty acid alkanolamides and molybdenum based friction modifiers was evaluated in tribology testing using 0W-20 motor oil. These very low viscosity oils place great demands on friction reducers and anti-wear agents. Specific tribological experiments were designed to evaluate the durability and performance retention of these formulations under isothermal conditions at 160° C. in order to simulate oil aging and higher mileage, and demonstrated a clear, unexpected combined synergy of the system.

Oil formulations were prepared using a 0W-20 motor oil without any friction modifier but containing all other additives. The molybdenum based friction modifier was a molybdenum dithiocarbamate complex prepared according to Example 1, and the fatty acid alkanolamide mixture was prepared according to Example 1.

Three lubricant compositions were prepared, a first comprising the 0W-20 oil and 1 wt %, based on the weight of the composition, of the molybdenum friction modifier (M), a second comprising the 0W-20 oil and 1 wt % of the alkanolamide mixture (A), and a third comprising the 0W-20 oil and 1 wt % of a 1:1 weight ratio mixture of the molybdenum based lubricating oil additive to alkanolamide (AM).

Figure 5:
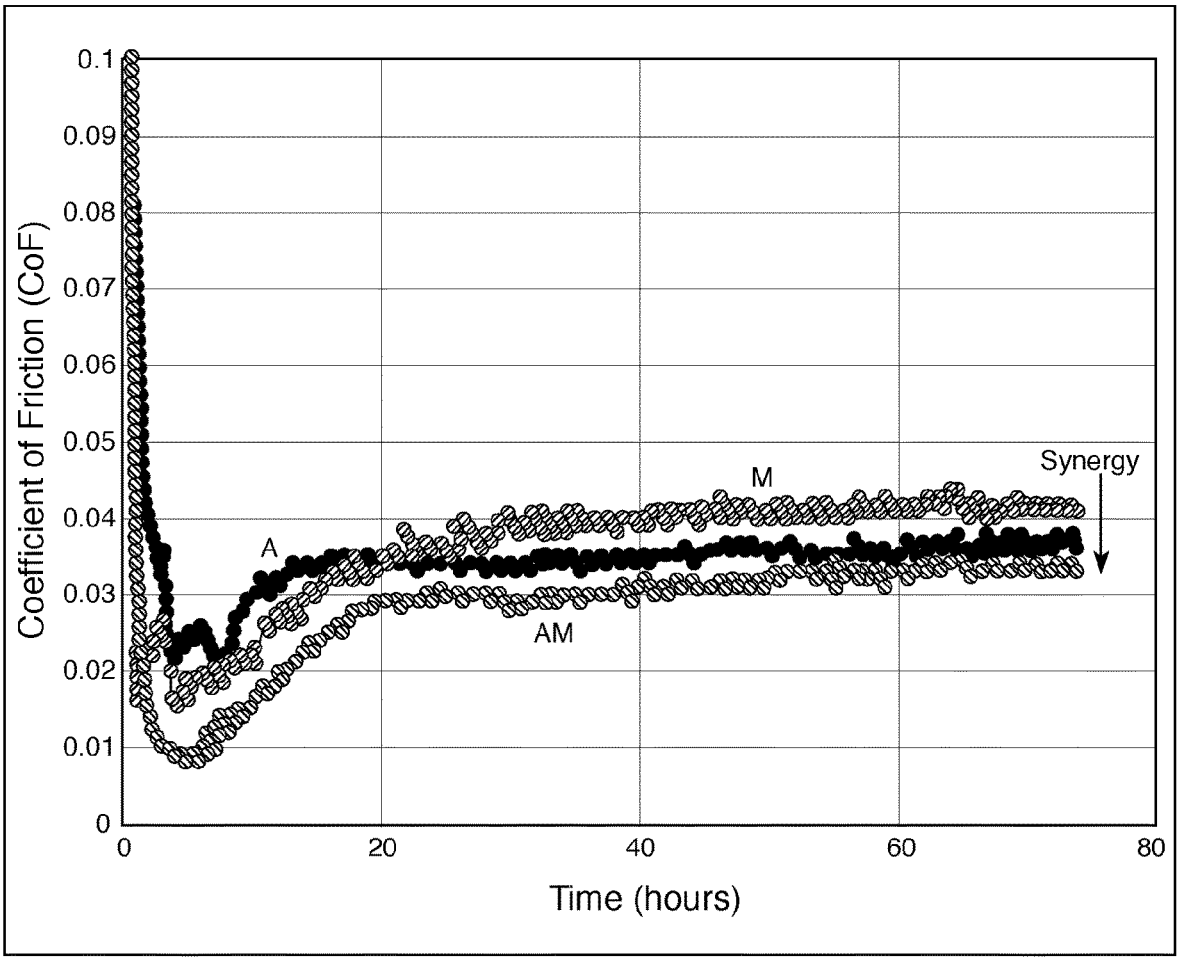
FIG. 5 shows friction reduction performance over time for a combination of alkanolamide and molybdenum friction modifiers.

FIG. 5 shows the results of tribology testing where the coefficient of friction was measured over time at 160° C. (isothermal testing) for line contact dowel pin sliding on a flat surface.

For all line contact measurements discussed herein the specimens consisted of a 16-mm long nitride steel dowel pin (6 mm diameter, RC hardness 60) rubbed against a hardened ground steel plate (RC hardness 60). The measurements were made with 100 N load at 1.75 Hz frequency and 4.5 mm amplitude stroke length. The sample comprising 1.0% of the molybdenum additive (M) initially showed greater friction reduction performance than 1.0% of the alkanolamide (A). However, after 20 hrs the CoF of the 1 wt % molybdenum additive sample (M) rises above the 1 wt % alkanolamide sample (A) and levels off, remaining above the alkanolamide. However, the formulation comprising 1 wt % of the 1:1 molybdenum additive/alkanolamide combination (0.5% molybdenum additive plus 0.5% alkanolamide) (AM) showed a synergistic effect, providing great improvement over the use of either molybdenum additive or alkanolamide alone. As shown, the Sample AM exhibited excellent friction reduction performance initially and maintained superior friction reduction performance compared to either of the molybdenum or alkanolamide formulations alone for the duration of the testing.

Example 5

In another test series, 5W-30 oils containing molybdenum additive and alkanolamide components, which were prepared as in Example 1, were evaluated for friction reduction activity and durability in performance in Cameron Plint TE-77 tribology testing (COF vs. Temperature). The table below shows the Coefficient of Friction for 5W-30 oil formulations containing 1 wt % of commercial molybdenum friction modifiers, COM-MOFM1 and COM-MOFM2, 1 wt % of the MoFM prepared according to Example 1, and 1 wt % of a 3:1 mixture of the alkanolamide to MoFM (each prepared according to Example 1). COM-MOFM1 (a commercially available di-molybdenum dithiocarbamate) was a friction reduction additive of approximately 5 wt % Mo by composition. COM-MOFM2 (a commercially available non-sulfur containing organo-molybdenum complex) was a friction reduction additive of approximately 8 wt % Mo by composition. The MoFM additive prepared according to Example 1 and used in the present Example contained ~4 wt % Mo, which was reduced further by blending with the alkanolamide. Also listed in the table below is the concentration of molybdenum in the respective oil formulations.

Cameron Plint TE-77—CoF vs. Temperature

| | 60° C. | 90° C. | 120° C. | 160° C. | Conc. of Mo in the resulting oil formulation |
|---|---|---|---|---|---|
| 1 wt % COM-MOFM1 (Comparative) | 0.12 | 0.11 | 0.075 | 0.055 | ~0.05 wt % |
| 1 wt % COM-MOFM2 (Comparative) | 0.10 | 0.095 | 0.095 | 0.075 | ~0.08 wt % |
| 1 wt % 3:1 Amide:Mo | 0.085 | 0.075 | 0.070 | 0.055 | ~0.01 wt % |
| 1 wt % Mo | 0.090 | 0.090 | 0.075 | 0.035 | ~0.04 wt % |

The data shows that the performance of the combination was better at low temperatures than the molybdenum alone, and approaches the same level of friction reduction at 160 C.

This mixture resulted in lower levels (down to ~0.01 wt %) of Molybdenum in the oil formulation (i.e., a 1 wt % total load of the combined additive composition, 0.25 wt % of which was the molybdenum friction modifier additive which contained approximately 4 wt % molybdenum). Thus, at the same total load levels (1 wt %) in the oil formulations, the tribology results demonstrate the excellent performance of the combined molybdenum and alkanolamide friction modifiers, which used significantly less Mo (~0.01 wt % concentration of Mo in the lubricant composition in this Example).

Example 6

In another example, the following compositions were prepared using Group II 5W-30 motor oil, which was a full formulation without any friction modifier but containing all other additives: 5W-30 oil without any friction modifier (S); 5W-30 oil and 1 wt %, based on the weight of the composition, of the molybdenum friction modifier (M) prepared according to Example 1; 5W-30 oil and 1 wt %, based on the weight of the composition, of the alkanolamide mixture (A) prepared according to Example 1; and 5W-30 oil and 1 wt %, based on the weight of the composition, of the molybdenum friction modifier and alkanolamide at a 1:1 weight ratio (AM).

Figure 6:
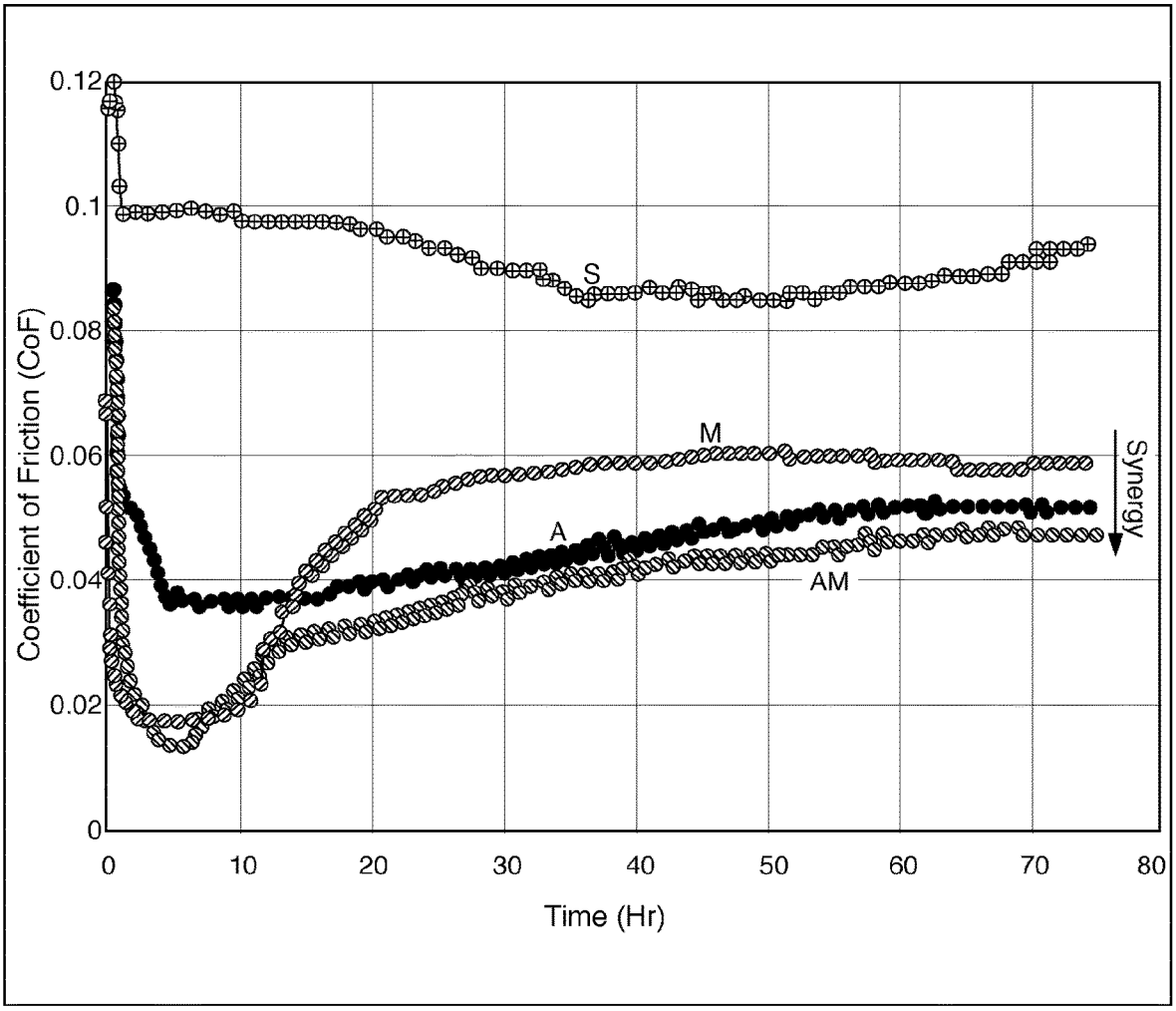
FIG. 6 shows friction reduction performance over time for a combination of alkanolamide and molybdenum friction modifiers.

The coefficient of friction was measured over time at 160° C. (isothermal testing) for line contact (1 mm piston ring sliding against 20 mm cylinder liner surface) with 100 N load at 1.75 Hz frequency and 4.5 mm amplitude stroke length. As shown in FIG. 6, results similar to those in FIG. 5 were observed. In particular, once again, the molybdenum additive/alkanolamide combination (0.5% molybdenum additive plus 0.5% alkanolamide) (AM) showed great improvement over the use of either of the components alone. In addition, the observed synergy allows one to achieve such improved performance using lower molybdenum content.

Example 7

Figure 7:
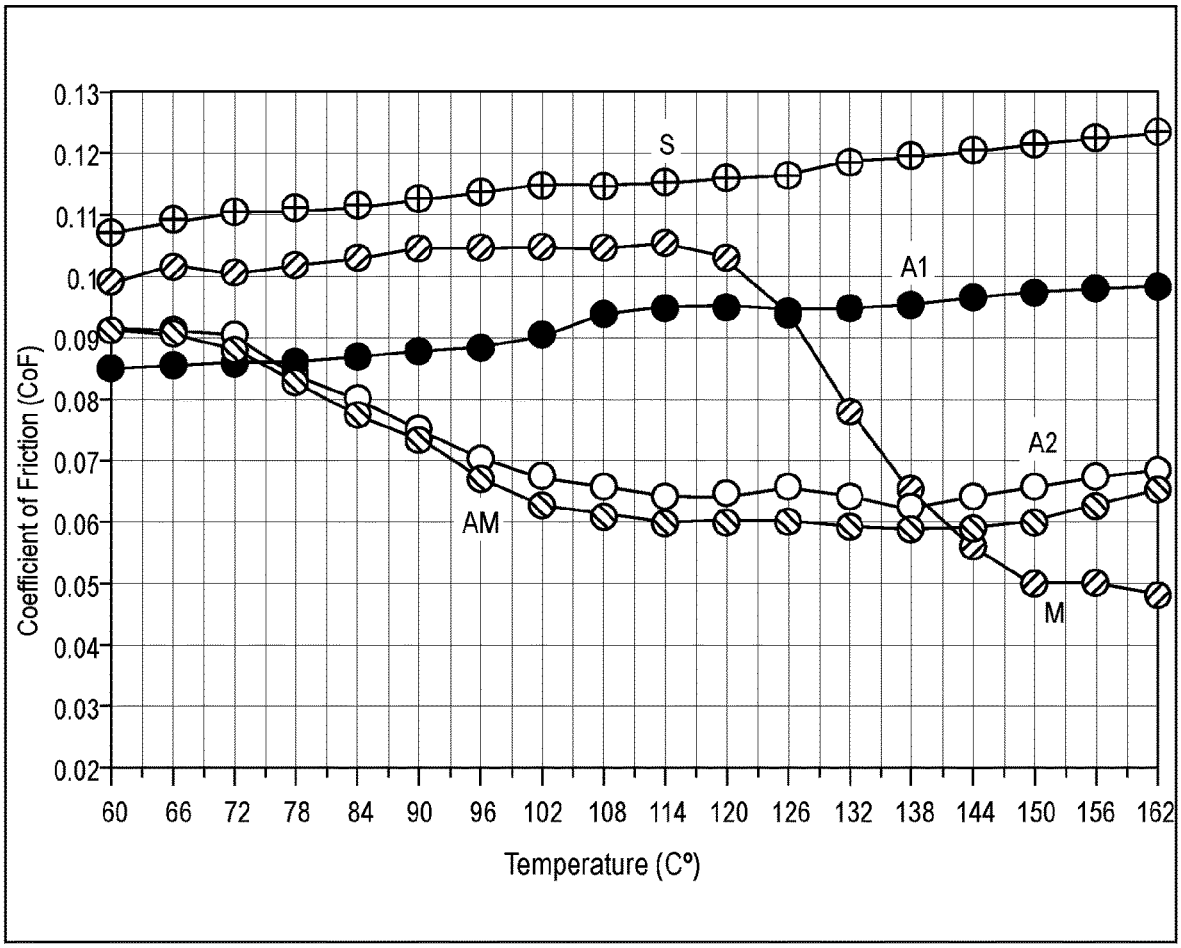
FIG. 7 shows friction reduction performance as a function of temperature for a combination of alkanolamide and molybdenum friction modifiers.

In a further example, the coefficient of friction was measured as temperature increased from 60° C. to 160° C. for line contact (dowel pin sliding on a flat surface) with 100 N load at 1.75 Hz frequency and 4.5 mm amplitude stroke length. FIG. 7 shows the results as a function of temperature under the above test conditions, using SAE 15W-40 (CJ-4) standard without any friction modifier (S), the standard plus 1 wt % of the alkanolamide above (A1), the standard plus 2 wt % of the alkanolamide (A2), the standard plus 1 wt % of the molybdenum additive above (M), and the standard plus 1.25 wt % of the alkanolamide and 0.3 wt % of the molybdenum additive (AM). At temperatures above 78° C., the 2 wt % alkanolamide additive (A2) significantly outperformed the 1 wt % alkanolamide additive (A2). Importantly, the combination of 1.25 wt % of the alkanolamide and 0.3 wt % of the molybdenum additive (AM) showed further improvement over A2. In addition, with the exception of temperatures over 144° C., the combination (AM), which included the molybdenum additive at only 0.3 wt %, showed a large improvement in performance over the molybdenum additive alone at 1 wt % (M).

Figure 8:
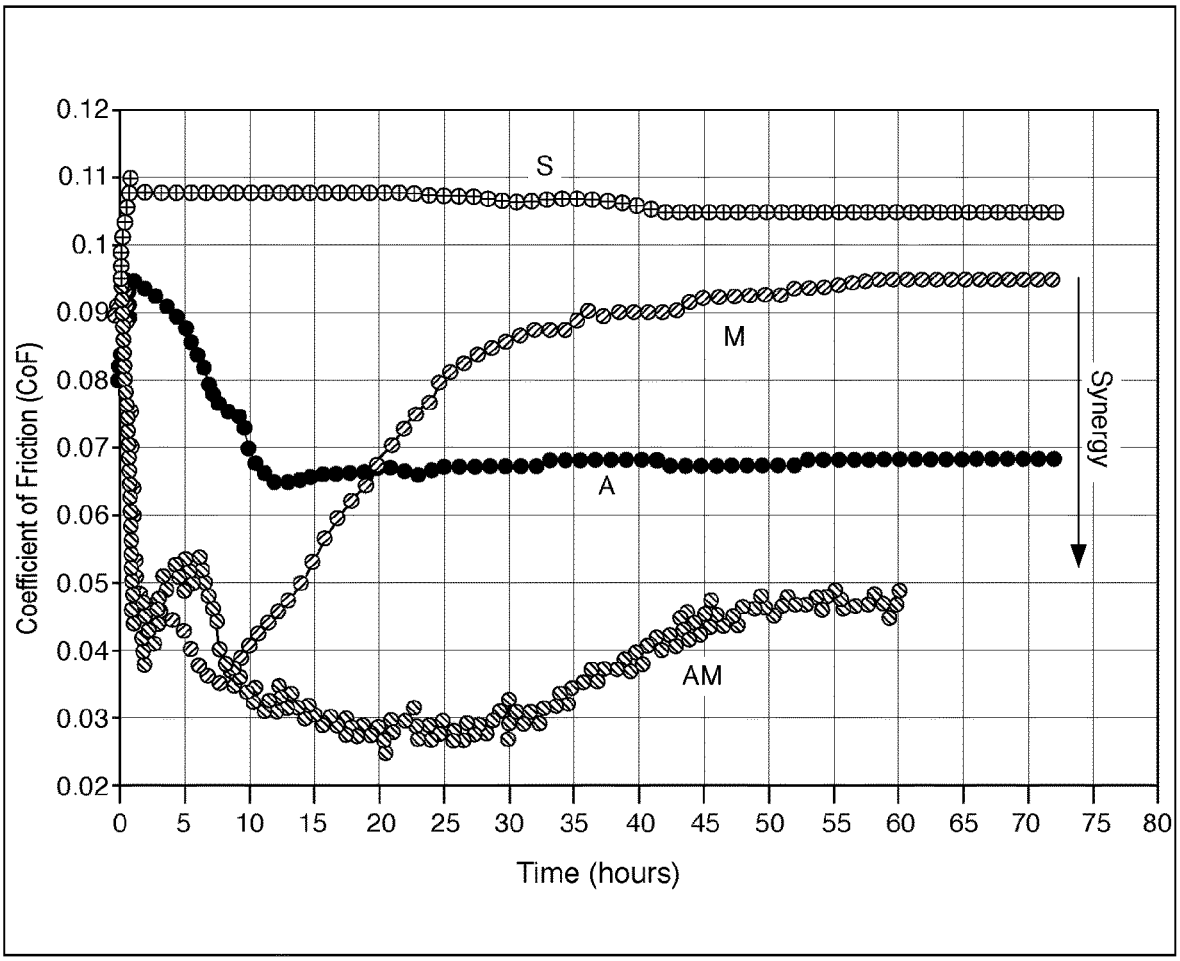
FIG. 8 shows friction reduction performance over time for a combination of alkanolamide and molybdenum friction modifiers.

FIG. 8 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length using HDDEO SAE 15W-40 standard without any friction modifier (S), the standard plus 1 wt % of the alkanolamide above (A), the standard plus 1 wt % of the molybdenum additive above (M), and the standard plus 0.5 wt % of the alkanolamide and 0.5 wt % of the molybdenum additive (AM). Once again, at the same total load level, the molybdenum additive/alkanolamide combination (AM) showed great Improvement over the use of either of the additives alone.

Example 8

Figure 9:
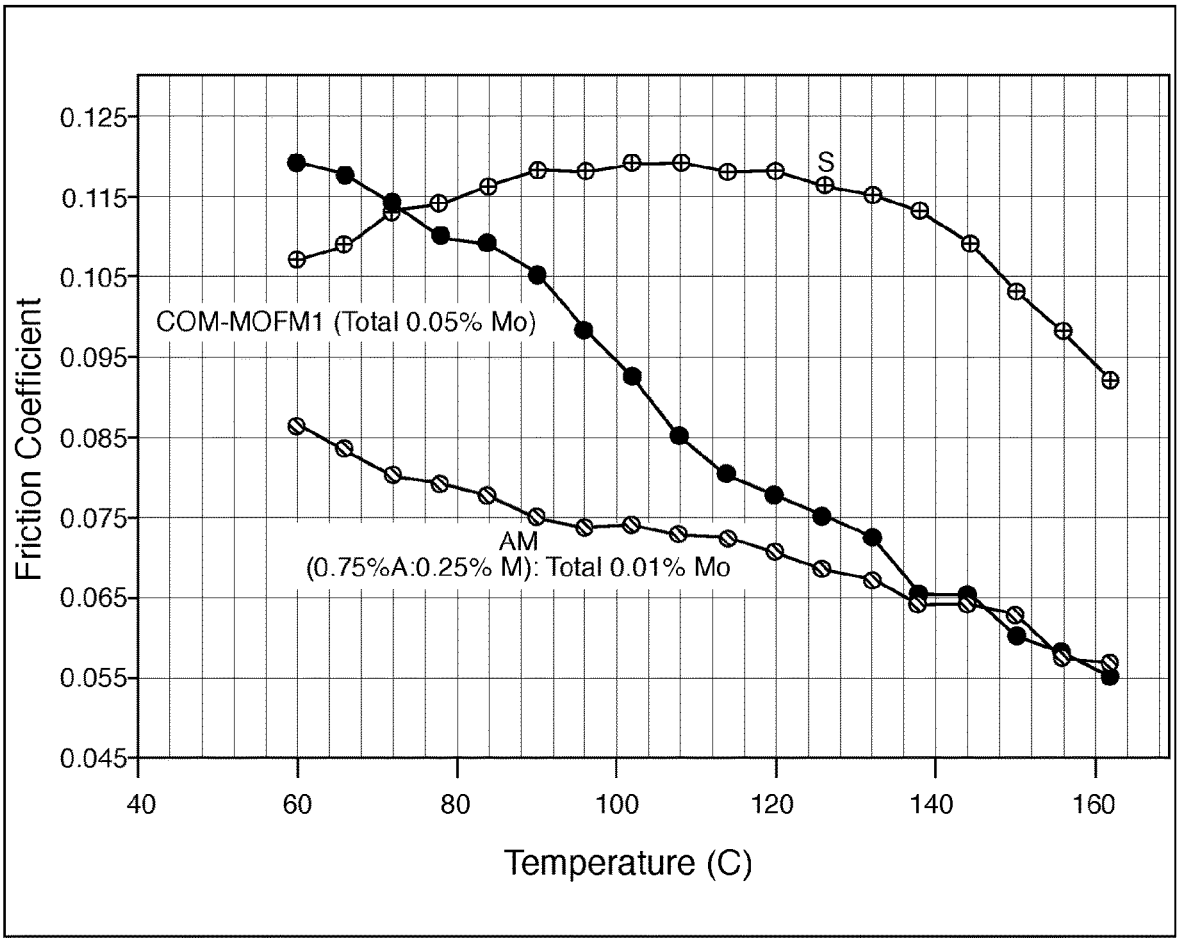
FIG. 9 shows friction reduction performance as a function of temperature for a combination of alkanolamide and molybdenum friction modifiers.

Coefficients of friction were measured as temperature increased from 60° C. to 160° C. for line contact (dowel pin sliding on a flat surface) with 100 N load at 5.0 Hz frequency and 2.35 mm amplitude stroke length. FIG. 9 shows the results as a function of temperature under the above test conditions using 5W-30 Group III PCMO without any friction modifier (the standard (S)), the standard plus 1 wt % of the commercial molybdenum dithiocarbamate friction modifier COM-MOFM1, and the standard plus 1 wt % of the alkanolamide mixture and the molybdenum additive, each prepared according to Example 1, at a 1:3 ratio by weight of molybdenum additive to alkanolamide (AM). The molybdenum content in the lubricant composition containing the commercial molybdenum friction modifier (COM-MOFM1) was approximately 0.05% (approximately 5% Mo content in the commercial additive at a treat rate of 1%), whereas the molybdenum content in the lubricant composition containing the mixture of the alkanolamide and molybdenum additive (AM) was approximately 0.01% (approximately 4% Mo content in the molybdenum additive of the Example at a treat rate of 0.25%). Despite containing approximately 5 times less molybdenum, the lubricant composition containing the mixture of additives (AM) exhibited highly superior performance from the outset of the experiment (at 60° C.) to about 130° C., around which point the friction coefficient for the COM-MOFM1 composition began to catch up with that of the AM sample.

Example 9

Figure 10:
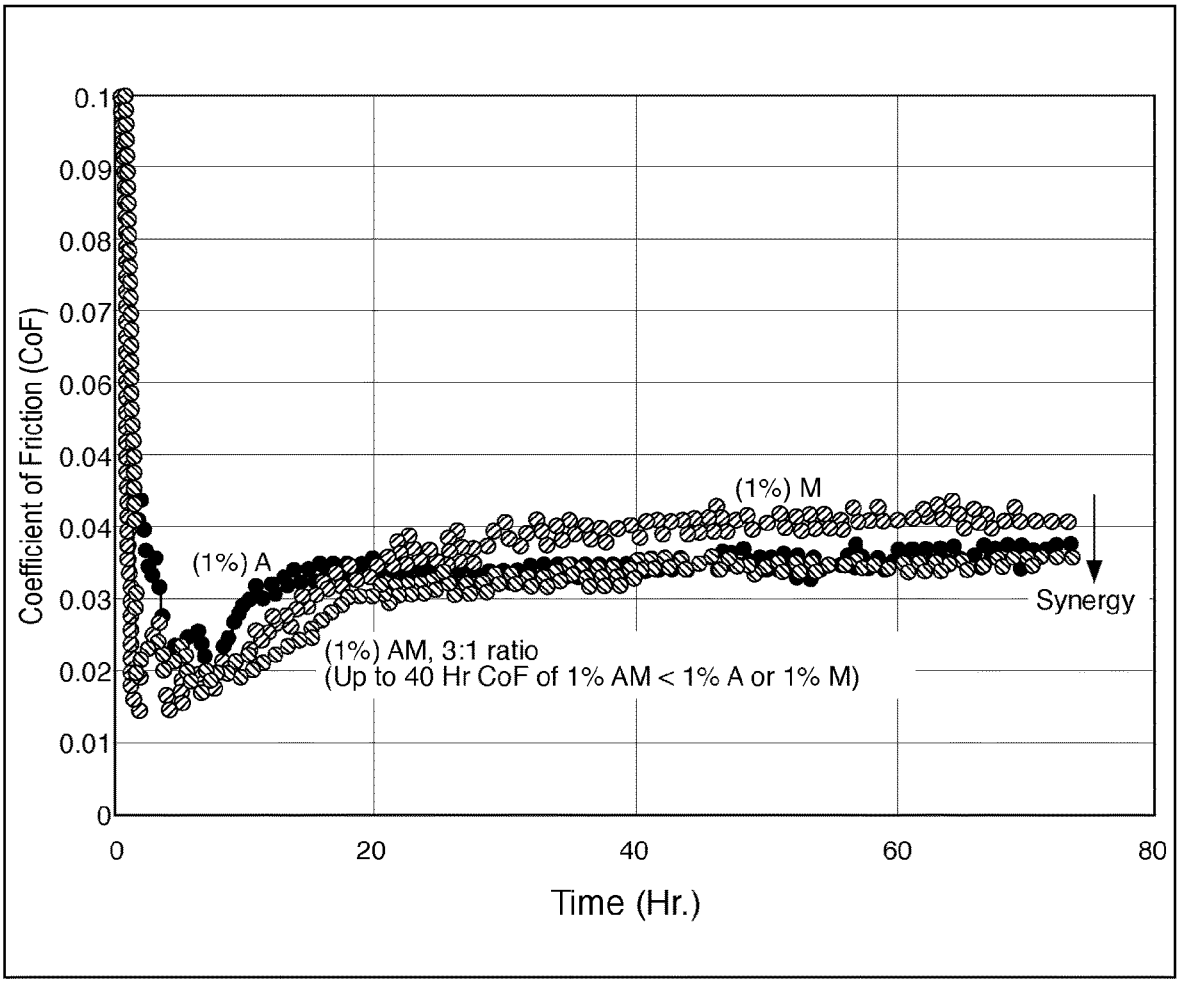
FIG. 10 shows friction reduction performance over time for a combination of alkanolamide and molybdenum friction modifiers.

FIG. 10 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length using 0W-20 PCMO without any friction modifier (the standard (S)), the standard plus 1 wt % of the alkanolamide above (A), the standard plus 1 wt % of the molybdenum additive above (M), and the standard plus 0.75 wt % of the alkanolamide and 0.25 wt % of the molybdenum additive (AM). At the same total load level (1%), the molybdenum additive/alkanolamide combination (AM) consistently showed greater friction reduction performance up to about 40 hours over the use of the additives alone.

Example 10

Figure 11:
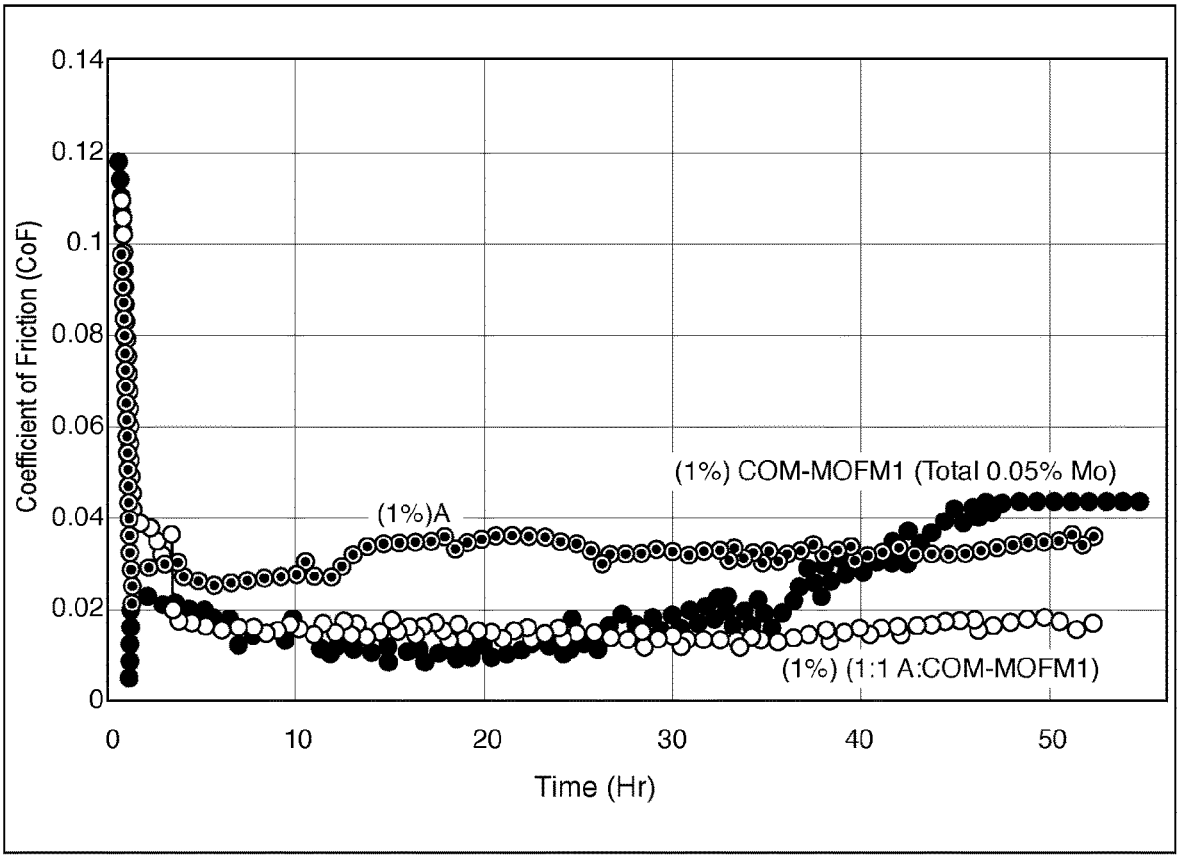
FIG. 11 shows friction reduction performance over time for a combination of alkanolamide and molybdenum friction modifiers.

FIG. 11 shows the results of performance retention testing where the coefficient of friction was measured over time at 160° C. (isothermal testing) for line contact (dowel pin sliding on a flat surface) with 100 N load at 1.75 Hz frequency and 4.5 mm amplitude stroke length. The additives were added to a 0W-20 PCMO without any friction modifier. The following formulations were tested: (1) the alkanolamide above at a treat rate of 1 wt % (A); (2) COM-MOFM1 (i.e., a commercially available di-molybdenum dithiocarbamate) at a treat rate of 1 wt % (Mo concentration in the resulting formulation was approximately 0.05%); and (3) a 1:1 combination by weight of the alkanolamide above and COM-MOFM1 at a treat rate of 1 wt % (A:COM-MOFM1). Once again, as shown in FIG. 11, the synergy of the alkanolamide/molybdenum additive combination resulted in superior retention of friction reduction performance.

Although particular embodiments of the present invention have been illustrated and described, this description is not meant to be construed in a limiting sense. Various changes and modifications may be made without departing from the principle and scope of the present invention, which is defined by the appended claims.

What is claimed:

1. A lubricant composition comprising:

A) a lubricating oil,

B) from about 0.2 to about 4.0 wt %, based on the total weight of the lubricant composition, of one or more overbased magnesium detergent, C) from about 0.2 to about 1.5 wt %, based on the total weight of the lubricant composition, of a mixed thio acid amide molybdenum dithiocarbamate comprising the reaction product of:

(a) an unsaturated or saturated ester or acid, (b) a diamine of the formula:

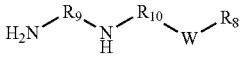

wherein $R_8$ is an alkyl group of 1 to 40 carbon atoms, $R_9$ and $R_{10}$ are independently selected aliphatic or aromatic moieties, and W is oxygen, sulfur, or —$CH_2$—, (c) carbon disulfide, and (d) a molybdenum compound, and D) from about 0.2 to about 1.5%, based on the total weight of the lubricant composition, of one or more fatty add 2-hydroxyalkylamide compounds of formula I:

I

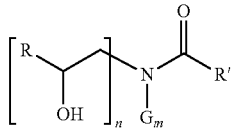

wherein n is 1 or 2; when n is 1, m is 1; when n is 2, m is 0,

R is H or $C_{1-12}$ alkyl,

G is H or $C_{1-6}$ alkyl, and

R' is selected from $C_{7-23}$ alkyl or alkenyl, and wherein the weight ratio of the molybdenum based friction reducing additive to the one or more fatty acid 2-hydroxyalkylamide compounds of formula I is from 1:1.1 to 1:5.

2. The lubricant composition according to claim 1 wherein the one or more overbased magnesium detergent comprises one or more magnesium sulfonates, magnesium salicylates, magnesium phenates, borated magnesium sulfonates, borated magnesium salicylates, or borated magnesium phenates.

3. The lubricant composition according to claim 1, wherein the unsaturated or saturated ester or add is a mono- or polyfunctional organic add or ester of the formula:

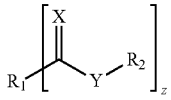

wherein $R_1$ is a straight chain or branched chain or cyclic, saturated or unsaturated, hydrocarbon moiety of 1 to 44, $R_2$ is hydrogen, a hydrocarbon radical, or a functionalized hydrocarbon radical having 1 to 18 carbon atoms, Z is an integer of 1 to 5, and X and Y are independently selected from the group consisting of sulfur and oxygen;

and the molybdenum compound is selected from molybdic acid, ammonium molybdate, $MoOCl_4$, $MoO_2Br_2$, $Mo_2O_3Cl_6$, $MoO_3$, and the thio analogues of the foregoing.

4. The lubricant composition according to claim 3 wherein, in the mono- or polyfunctional organic acid or ester of the formula:

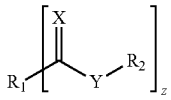

$R_1$ is a $C_{2-24}$ straight chain or branched chain or cyclic, saturated or unsaturated, hydrocarbon moiety, and in the diamine of the formula

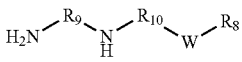

$R_8$ is an alkyl group of 8 to 24 carbon atoms and $R_9$ and $R_{10}$ are ethylene, propylene, or isopropylene, and W is oxygen or —$CH_2$—.

5. The lubricant composition according to claim 1, wherein the acid and/or ester used in making the mixed thio acid amide molybdenum dithiocarbamate comprises octanoic, nonanoic, decanoic, dodecanoic, myristic, palmitic, stearic, arachidonic, decanoic, myristoleic, oleic or linoleic acid.

6. The lubricant composition according to claim 1, wherein the acids and/or esters used in making the mixed thio acid amide molybdenum dithiocarbamate comprises ethylene glycol dioleate, propylene glycol dioleate, butanediol dioleate, glycerol monooleate, glycerol linoleate, glycerol linolenate, glycerol trioleate, pentaerythritol tetraoleate, pentaerythritol trioleate monomyristate, trimethylol propane trioleate, trimethylol propane dioleate monomyristate, trimethylol propane dilinoleate monooleate, dioleyl adipate, dioleyl sebacate, dioleyl maleate, dioleyl succinate, or dilinoleyl adipate.

7. The lubricant composition according to claim 1, wherein a vegetable oil is used as the source of the ester used in making the mixed thio acid amide molybdenum dithiocarbamate.

8. The lubricant composition according to claim 7, wherein the vegetable oil comprises canola oil, corn oil, coconut oil, sunflower oil, soybean oil, lard, or palm oil.

9. The lubricant composition according to claim 8, wherein the vegetable oil comprises canola oil.

10. The lubricant composition according to claim 1, wherein the diamine used in making the mixed thio acid amide molybdenum dithiocarbamate comprises octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane.

11. The lubricant composition according to claim 1, wherein the mixed thio acid amide molybdenum dithiocarbamate is the reaction product of (a) a vegetable oil;

(b) a diamine comprising octyl/decyloxypropyl-1,3-diaminopropane, isodecyloxypropyl-1,3-diaminopropane, isododecyloxypropyl-1,3-diaminopropane, dodecyl/tetradecyloxypropyl-1,3-diaminopropane, isotridecyloxypropyl-1,3-diaminopropane, tetradecyloxypropyl-1,3-diaminopropane, N-coco-1,3-diaminopropanes, N-tallow-1,3-diaminopropanes, or N-oleyl-1,3-diaminopropane;

(c) carbon disulfide: and (d) $MoO_3$.

12. The lubricant composition according to claim 1, wherein in formula R is methyl.

13. The lubricant composition according to claim 1, wherein the one or more fatty acid 2-hydroxyalkylamide compounds are a mixture of compounds of formula I, wherein about 15 to about 45% by weight of the 2-hydroxyalkylamide compounds are compounds where R' is $C_{15}$ alkyl or alkenyl, about 40 to about 80% by weight of the 2-hydroxyalkylamide compounds are compounds where R' is $C_{17}$ alkyl or alkenyl, and 0 to about 15% by weight of the 2-hydroxyalkylamide compounds are compounds where R' is $C_{7-14}$, $C_{16}$ or $C_{18-19}$ alkyl or alkenyl.

14. The lubricant composition according to claim 13, wherein in formula I R is methyl.

15. The lubricant composition according to claim 1, wherein the one or more fatty add 2-hydroxyalkylamide compounds are prepared by reacting a di(hydroxyalkyl) amine with carboxylic adds or carboxylic add derivatives from canoe oil, corn oil, coconut oil, sunflower oil, soybean oil, lard, palm oil, beef tallow, cocoa butter, or illipe.

16. The lubricant composition according to claim 15 wherein the di(hydroxyalkyl)amine is bis(2-hydroxypropyl) amine.

17. The lubricant composition according to claim 15, wherein the one or more fatty acid 2-hydroxyalkylamide compounds are prepared by reacting bis(2-hydroxypropyl) amine with methyl esters derived from beef tallow carboxylates.

18. The lubricant composition according to claim 1, wherein the one or more fatty acid 2-hydroxyalkylamide compounds of formula I have a structure according to formula II:

II

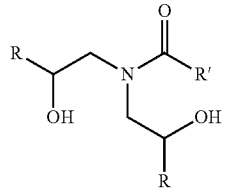

wherein R is H or $C_{1-12}$ alkyl; and R' is selected from $C_{7-23}$ alkyl or alkenyl.

19. A lubricant composition comprising:

A) a lubricating oil;

B) from about 0.2 to about 4.0 wt %, based on the total weight of the lubricant composition, of an overbased magnesium detergent;

C) from about 0.2 to about 1.5 wt %, based on the total weight of the lubricant composition, of a molybdenum based friction reducing additive comprising the reaction product of:

(a) an unsaturated or saturated ester or acid, (b) a diamine of the formula:

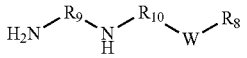

wherein $R_8$ is an alkyl group of 1 to 40 carbon atoms, $R_9$ and $R_{10}$ are independently selected aliphatic or aromatic moieties, and W is oxygen, sulfur, or —$CH_2$—, (c) carbon disulfide, and (d) a molybdenum compound, and D) from about 0.2 to about 1.5 wt %, based on the total weight of the lubricant composition, of one or more tatty acid 2-hydroxyalkylamide compounds of formula I:

I

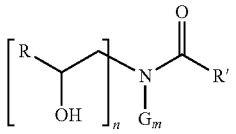

wherein n is 1 or 2; when n is 1, m is 1; when n is 2, m is 0, R is H or $C_{1-12}$ alkyl, G is H or $C_{1-6}$ alkyl, and R' is selected from $C_{7-23}$ alkyl or alkenyl, and wherein the weight ratio of the molybdenum based friction reducing additive to the one or more fatty acid 2-hydroxyalkylamide compounds of formula I is from 1:1.1 to 1:5.

20. The lubricant composition of claim 19, wherein the combined weight of the molybdenum based friction reducing additive and the one or more fatty acid 2-hydroxyalkylamide compounds of formula I is from about 0.4 to about 3 wt % based on the total weight of the lubricant composition.

21. The lubricant composition according to claim 19, wherein the one or more fatty acid alkanolamide compounds have a structure according to formula

II

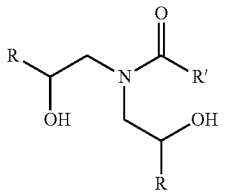

wherein R is H or $C_{1-12}$ alkyl; and R' is selected from $C_{7-23}$ alkyl or alkenyl.

22. The lubricant composition according to claim 19, wherein the molybdenum based friction reducing additive is selected from the group consisting of molybdenum dithiocarbamates, molybdenum dithiophosphates, molybdenum dithiophosphinates, molybdenum xanthates, molybdenum thioxanthates, molybdenum sulfides, and mixtures thereof.

23. The lubricant composition according to claim 19, wherein the molybdenum based friction reducing additive comprises a molybdenum dithiocarbamate represented by the formula:

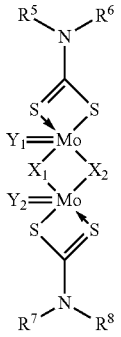

wherein $R^5$, $R^6$, $R^7$, and $R^8$ each independently represent a hydrogen atom, a $C_{1-20}$ alkyl or alkenyl group, a $C_{5-20}$ cycloalkyl, aryl, alkylaryl, or aralkyl group, or a $C_{3-20}$ hydrocarbyl group terminating in an ester, ether, alcohol, amine, amide or carboxyl group; and $X_1$, $X_2$, $Y_1$, and $Y_2$ each independently represent a sulfur or oxygen atom.

24. The lubricant composition according to claim 21, wherein the molybdenum based friction reducing additive is selected from the group consisting of molybdenum dithiocarbamates, molybdenum dithiophosphates, molybdenum dithiophosphinates, molybdenum xanthates, molybdenum thioxanthates; molybdenum sulfides, and mixtures thereof.

25. A method for lowering friction in a lubricant composition comprising from about 0.2 to about 4.0 wt %, based on the total weight of the resulting lubricant composition, of an overbased magnesium detergent, said method comprising adding to the lubricant composition from 0.2 to 1.5 wt %, based on the total weight of the resulting lubricant composition, of a mixed thio acid amide molybdenum dithiocarbamate comprising the reaction product of:

(a) an unsaturated or saturated ester or add, (b) a diamine of the formula:

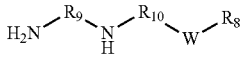

wherein $R_8$ is an alkyl group of 1 to 40 carbon atoms, $R_9$ and $R_{10}$ are independently selected aliphatic or aromatic moieties, and W is oxygen, sulfur, or —$CH_2$—, (c) carbon disulfide, and (d) a molybdenum compound, and D) from about 0.2 to about 1.5 wt %, based on the total weight of the lubricant composition, of one or more fatty add 2-hydroxyalkylamide compounds of formula I:

I

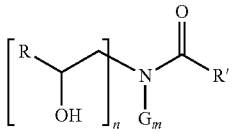

wherein n is 1 or 2; when n is 1, m is 1; when n is 2, m is 0,

R is H or $C_{1-12}$ alkyl,

G is H or $C_{1-6}$ alkyl, and

R' is selected from $C_{7-23}$ alkyl or alkenyl, and wherein the weight ratio of the molybdenum based friction reducing additive to the one or more fatty add 2-hydroxyalkylamide compounds of formula I is from 1:1.1 to 1:5.

26. The method of claim 25, further comprising adding to the lubricant composition from 0.2 to 1.5 wt %, based on the total weight of the resulting lubricant composition, of one or more fatty acid alkanolamides of formula II:

II

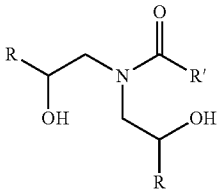

wherein R is H or $C_{1-4}$ alkyl; and R' is selected from $C_{7-19}$ alkyl or alkenyl.

27. A method of preventing or reducing the occurrence of Low Speed Pre-ignition in an internal combustion engine wherein the crankcase of the engine is lubricated with the lubricant composition according to claim 1.

* * * * *